US005522339A

United States Patent [19]

Pelly

[11] Patent Number: 5,522,339

[45] Date of Patent: Jun. 4, 1996

[54] COLLAPSIBLE MULTI-HULLED VESSEL

[76] Inventor: Charles W. Pelly, 4137 Rosario Rd., Woodland Hills, Calif. 91364

[21] Appl. No.: 391,020

[22] Filed: Feb. 21, 1995

[51] Int. Cl.[6] ..... B63B 7/00

[52] U.S. Cl. ..... 114/354; 114/61

[58] Field of Search ..... 114/39.1, 61, 783, 114/353, 354

[56] References Cited

U.S. PATENT DOCUMENTS 3,460,502 8/1969 Carmichael ..... 114/61

FOREIGN PATENT DOCUMENTS 684133 4/1964 Canada ..... 114/354

*Primary Examiner*—Jesus D. Sotelo

*Attorney, Agent, or Firm*—Nydegger & Associates

[57] ABSTRACT

The present invention relates to a collapsible multi-hulled vessel capable of opening and collapsing with line(s). The vessel sails in full width, open position yet collapses to sufficient size to permit easy transport and storage. The mast and rigging remain intact during the opening and collapsing procedure thereby further easing the change. Central hinging, containment doors, and containment door latching mechanisms provide added ease of operation and security.

7 Claims, 9 Drawing Sheets

PUSHING OUTWARDLY IN A FORWARD DIRECTION SAID COLLAPSIBLE MEMBER STERN-TO-BOW MAIN FOLDING HINGE BOW SUPPORT RESULTING IN SIMULTANEOUS OUTWARD OPENING OF SAID PORT SIDE COLLAPSIBLE MEMBER BOW CONTAINMENT DOOR AND SAID STARBOARD SIDE COLLOAPSIBLE MEMBER BOW CONTAINMENT DOOR BEING HINGEDLY CONNECTED TO SAID PORT SIDE COLLAPSIBLE MEMBER BOW CONTAINMENT DOOR HINGE SUPPORT AND LATCHING MECHANISM AND SAID STARBOARD SIDE COLLAPSIBLE MEMBER BOW CONTAINMENT DOOR HINGE SUPPORT;

PUSHING OUTWARDLY IN A FORWARD DIRECTION SAID COLLAPSIBLE MEMBER STERN-TO BOW MAIN FOLDING HINGE STERN SUPPORT RESULTING IN SIMULTANEOUS OUTWARD OPENING OF SAID PORT SIDE COLLAPSIBLE MEMBER STERN CONTAINMENT DOOR AND SAID STARBOARD SIDE COLLAPSIBLE MEMBER STERN CONTAINMENT DOOR BEING HINGEDLY CONNECTED TO SAID PORT SIDE COLLAPSIBLE MEMBER STERN CONTAINMENT DOOR HINGE SUPPORT AND LATCHING MECHANISM AND SAID STARBOARD SIDE COLLAPSIBLE MEMBER STERN CONTAINMENT DOOR HINGE SUPPORT;

LIFTING UPWARDLY SAID COLLAPSIBLE MEMBER STERN-TO-BOW MAIN FOLDING HINGE RESULTING IN SIMULTANEOUS UPWARD LIFTING OF SAID COLLAPSIBLE MEMBER PORT SIDE FOLDING BOTTOM PANEL AND SAID COLLAPSIBLE MEMBER STARBOARD SIDE FOLDING BOTTOM PANEL BEING HINGEDLY CONNECTED AT AN OPPOSITE LONGITUDINAL DISTAL END TO SAID PORT HULL BOTTOM-TO-PORT PANEL HINGE AND SAID STARBOARD HULL BOTTOM-TO-STARBOARD PANEL HINGE;

COLLAPSING SAID PLURALITY OF HULLS TOGETHER IN A COMPACT CONFIGURATION.

FIG. 9

COLLAPSIBLE MULTI-HULLED VESSEL

BACKGROUND OF THE INVENTION

1. Field of the Invention

The present invention relates to a multi-hulled vessel capable of being collapsed to a substantially smaller form when not in use in order to facilitate both portability from one location to another and minimize storage area.

2. Description of the Prior Art

The superior nautical qualities of the multi-hulled type vessels have been known for many years. Because of their high beam-to-length ratio and their shallow draft, multi-hulled type vessels exhibit desirable seaworthy qualities of stability and resistance to capsizing equivalent to those of much larger single hull vessels. In addition, multi-hulled vessels are much faster than single hulled water vessels.

Ocean cruising multi-hull vessels have been known for over 3,000 years. Heretofore, such multi-hulled boats have often been difficult and awkward to maneuver in relatively tight marina berthing procedures, or in packed anchorage areas. This is primarily due to their comparatively massive beam width. Additionally, these wonderfully performing open vessels are non transportable by motor trailer because of their girth. Efforts have been made by inventors to overcome this particular difficulty by collapsing the hulls in various ways, generally resulting in serious design compromise. The previous improvements have been less than satisfactory.

There are two basic practical approaches to multi-hull vessels. One is using telescoping transverse tubes that slide the hulls together. The other is using pivoting swing arms that narrowly tilts or swings the hulls inward. Otherwise, the procedure is to spend hours in dismantling or collapsing the entire vessel.

Despite these obvious and well know advantages, multi-hulled vessels have not enjoyed the degree of popular acceptance that one would expect of a vessels of this nature. A principle reason for this lack of acceptance is the awkward bulk of the double hull design which makes handling, transportation and storage difficult and inconvenient. Many boat owners prefer to remove their boats from the water in the winter months to forestall fouling of the bottom and thereby greatly reduce the maintenance that would otherwise be necessary if the boat were left in the water all year. Single hull boats are easily removed from the water by means of the conventional ramp and trailer arrangement, but because of the catamaran's wide beam, they require much wider trailers or other special equipment to be removed from the water and transported. Alternatively, conventional catamarans must be disassembled in the water and removed one hull at a time. The storage of conventional catamarans is expensive and inconvenient because of the wide beam which occupies a great deal more space than an equivalent sized single hull boat. Such vessels are capable of providing very large working deck areas at relatively low cost and at relatively small draft. However, because of the increased difficulty, inconvenience and time loss involved in the handling, transportation and storage of conventional multi-hulled vessel, many prospective multi-hull owners decide against buying a such a vessel and instead buy a single hull boat.

To overcome these problems, there have been attempts in the past to design a multi-hulled type vessels which collapses into a transportable package, but these designs have been either excessively complicated and expensive to manufacture and maintain, or flimsy and unseaworthy. In addition, the procedure for collapsing the multi-hulled vessel into a transportable package is frequently so complicated and time consuming that the prospective owner is unwilling to undertake the chore and instead buys a single hull vessel.

Early prior art shows a trimaran sail craft having a folding-hull member pivoting upon longitudinal axes at each outermost right and left sides of the cabin structure. This is achieved without disturbing the center cabin occupancy. In this method, the hulls are cantilevered transversely out on pivot arms.

However, the outboard hulls are useless for cabin occupancy or buoyancy, since they rotate about 80 degrees upon their sides when deployed into their fully retracted position. Hence, this configuration lacks the spatial volumetric efficiency which the present invention teaches elsewhere herein, whereby outrigger hulls can also provide comfortable occupancy; efficiently utilizing the otherwise dead weight, draft drag imposed by the stabilizer hulls of this old art.

Accordingly, there has existed in the art a long-standing need for a collapsible multi-hulled vessel which may be folded quickly and easily into a convenient package for transportation and storage and which, when afloat, provides a strong and reliable water craft which the owner may sail with confidence.

The invention provides a collapsible boat comprising at least one pair of longitudinally hingedly interconnected hulls the inner longitudinal edges of which are respectively hinged to the bottom panels, the direction and extent of the hinged rotation of the panels being such that when the boat is erected the bottom panels hinge open to their maximum extent and to collapse the boat alternate hinges rotate in opposite senses so that the bottom panels fold inwardly of the hulls.

A variety of different catamarans or catamaran type frames have been proposed in various forms. A simple form of frame in which a rigid longitudinal beam is secured along the top of each hull and a pair of spaced cross beams are secured between the longitudinal beams, to form a frame. This frame is then secured together simply by fastening the components together, so that the frame must be virtually completely dismantled to transport or store the catamaran. A drawback of this design is that the longitudinal beams are the same length as the hulls, and therefore are over-long for convenient storage or transport.

Others designs disclose a frame consisting of a central torsion beam which extends substantially parallel to the length of the hulls, with cross members secured at right angles to the longitudinal torsion beam, to form a frame. The free ends of the cross members are secured to the hulls. However, this design suffers from the same drawbacks; portability.

Still other similar designs include a frame consisting of a central rigid member lying substantially parallel to the spaced hulls, and connected to the hulls by a series of rigid bridging members. In this design, each of the hulls is reinforced by an internal rigid tube which extends substantially the full length of the hull. As with the proposals discussed above, the frame has to be dismantled for storage or transport.

Previous art discloses a simple (generally rectangular) frame whereby the sides rest on top of the spaced hulls and are secured thereto. The frame includes a large number of components which are push fitted and pinned together, making assembly/disassembly and transport of the frames relatively complex.

Other patents relate to multi-hull crafts and disclose a basically triangular frame configuration, in which the spars which extend from the center hull to the two outer hulls may be pivoted to a position above the center hull for storage or transport. This frame, however, is attached to the hulls only at a single point on each hull, thus, the frame does little to stabilize the hulls, and the attachment points tend to be over stressed, since all the stresses between the frame and the hulls are concentrated at those specific points.

Still other prior art disclose a frame whereby the arrangement for joining two surfboards to form a catamaran type of craft has side members which can be pivoted in a horizontal plane for storage or transport of frame. The pivoting arrangement is such that the frame cannot be collapsed for storage or transport without first detaching the surfboards from the frame. Also, the frame has a geometry which is far from ideal; the frame members which extend outwards to the outer hulls are secured to those hulls only in a single plane, thus, the frame is torsionally weak.

Typically, a sailboat of the multi-hulled type has multiple hulls joined by wedge shaped crossbeams, the crossbeams geometry being oriented to provide balanced distribution of loading on the hulls and crossbeams. An easily dismantable, multi-part mast is stepped on the forward crossbeam and has a hook engaged by a ring or the like which is coupled to the shrouds and stay cables. Also, the mast and boom are capable of being folded when into a collapsed position when not in use. The rudder assembly includes an extruded rudder blade mounted in a rudder guide for vertical movement such that it is automatically raised upon encountering an obstruction.

Typically, a boat hull has a V shaped keel region and a frame on deck connected to points along the keel region by rods of adjustable effective length. Any limited part of the keel region can be deflected in one direction by increasing the length of the rod connecting the frame to the part of the keel region and in the opposite direction by reducing the length of that rod.

Previous art includes a knockdown fishing and/or leisure boat comprising two identical floats on which rests a deck. Each of the floats is provided, in its superior median axis, with a plurality of threaded bolts evenly spaced to assure dismountable attachment of a same quantity of identical deck planks connecting the two floats parallel to each other. This is accomplished by means of an opening provided at each extremity of the planks to allow the threaded bolts of the float to pass through. A manually turnable nut is threaded on each bolt to tighten each plank to the floats.

Other art includes a combination catamaran boat and cross water ski system includes left and right hulls, a bridging deck, and a steering system. Each hull includes a rudder in its keel portion and a rudder plate on its top, connected by a rudder shaft for pivotal movement. A foot piece on each rudder plate is for a skier's feet. The steering system includes a tiller above the deck connected to a tiller lever system below the deck, and a rudder crossbar connecting the tiller lever system to the rudder plates on the hulls. The left and right hulls are separable from the deck and steering system, and convertible to use as right and left cross water skis respectively. Ski poles each include a handle with an upper portion and laterally offset lower portion, and a pontoon.

Still other art includes a collapsible secured beneath each cross bar and a pair of tubular end pieces for telescopically receiving the longitudinally extending tubular members respectively. The tubular end pieces are secured to the lateral ends of the cross bar and includes locating holes and an orienting slot for the longitudinally extending tubular member and the tubular pieces. It will be appreciated that the tubular end pieces can be cast as "T" shaped members identical to the "T" shaped mast stepping member as described later herein.

The inflatable hulls of the prior art have sections which extend fore and aft of the rectangular frame so as to assure a smooth pass of the main hull portions into and through the water. A pair of dagger boards are adjustably secured to the central cross bar sub-frame at the lateral ends thereof and a single rudder is pivotally mounted in the center of the aft cross bar. The rudder assembly includes a frame which slidably receives a rudder which preferably is identical to each of the dagger boards so that should one dagger board or rudder be lost, the catamaran is still sailable and can be safely returned because of the interchangeability of the rudder and dagger board units. When the mast has been stepped, non-metallic rope stays are secured to the forward end of the longitudinally extending tubular members via rope guide and jam cleat assemblies.

The tubular end pieces on the central cross bar sub-frame are telescopically received on a pair of short tubes (or a pair of the longer longitudinal members may be used for this purpose) with the fore the control spar thereby shifting the control spar axially forward relative to the carriers and folding the center struts at the hinged midpoint to bring the carriers together. The mast may be telescoped to that in collapsed condition it does not extend beyond the ends of the package.

Still other art depicts a boat, especially a catamaran, having a rectangular collapsible frame with a one man mast stepping structure. The tubular frame is comprised of fore, aft and central sub-frame assemblies which can be collapsed so as to be easily car topable and serve as a rack for containing other components of the catamaran. Inflatable hulls are secured in bracket arches on the underside of the sub-frame assemblies. A rudder frame or cage is pivotally mounted on an aft sub-frame assembly and is adapted to receive a rudder, which is identical to and interchangeable with dagger boards. A system of adjustable rope stays is provided for adjusting the mast.

Some prior art exhibit elements such as a frame for supporting a trampoline including fore and aft cross bar sub-frames and a central cross bar sub-frame. For smaller boats, one of the sub-frames assemblies may be eliminated. Longitudinally extending tubular members extend between the fore cross bar and central cross bar sub-frames and a second pair of longitudinally extending tubular members are telescopically received in the end sections of the sub-frames. Each sub-frame includes a cross bar and a laterally spaced pair of semi-circular hull encompassing or arched brackets catamaran sailboat having a trampoline and a frame. The frame comprises two spaced cross tubes each having two ends. The frame further comprises two longitudinal, spaced hulls and a mechanism for releasably attaching one end of each cross tube to one of the hulls and the other end of each cross tube to the other of the hulls. The catamaran sailboat further comprises a mechanism for attaching the trampoline to the frame.

U.S. Pat. No. 4,766,830 issued to Kunz also discloses a catamaran with a collapsible frame. The reference teaches the use of a tubular frame which is made up of four, aft central sub-frame assemblies. The inflatable hulls are then attached to the underside of the sub-frame assemblies.

These references, as well as other collapsible catamarans, call for a least a four sided frame which is then attached to the hulls or hulls. The catamaran assemblies are often quite complex, involving many removable parts, making disassembly and transport time consuming and burdensome.

Other prior art includes a collapsible multi-carrier wind propelled vehicle including a pair of spaced carriers connected by centrally hinged struts. A center control spar is connected to the struts at the hinged midpoint and a mast is stepped on the spar by a hinged connector. One or more mast brace spars are pivotally connected at one end to the mast and at the other end connected to a respective one of each of the carriers. The vehicle is collapsed in a convenient package for transportation by folding the mast down parallel to and aft sub-frame assembly being telescopically received pairs of short tubes and locked in position to constitute a collapsed frame so that this collapsed frame can then be inverted and mounted on the car top with three of the semi-circular hull encompassing brackets aligned transversely of the car to serve as a carrier for deflated hulls, trampoline, rudder and dagger boards and sail and other components of the boat.

Still other inventions include a pontoon boat, of the type having two hulls upon which is erected a platform and railing, for use as a shallow draft vessel, is shown having the platform and railings of a particular collapsible construction specifically adapted for rapid, complete and compact disassembly for ease of over-the-road transportation. Each pontoon is constructed of two end-to-end canoe shaped flotation structures having a perpendicular end for abutment and bolting together, and a tapered end for lessening water drag. On a flat top of each pontoon, mating left and right receiving support points hold the collapsible platform frame. Two identical, facing collapsible platform frames have pin and socket connections for interlinking with the hulls, and have a removable floor plate which rests in a hinged bottom support frame. The bottom frame and two hinged side rail sections fold against a fixed back rail. The proportions of all components are chosen so that the side rails fold directly against the back frame and the bottom support frame folds up producing a flat, easily transported structure. The resulting structure is compact and easily transported when broken down, but provides for a substantially strong rail form the pontoon platform when erected.

When it is necessary to move the pontoon boat by over-the-road transportation, the pin and socket joints are unlocked, the three platform deck plates are removed, and each of the pair of deck frames is then slid free of the receiving pontoon structures. The side rails are then folded in against the back rail and the bottom frame section folded up providing two relatively flat, rectangular structures that are easily stacked. The pontoon structures are then unlocked by removing the locking pins from the pair of pin and socket joints, providing four pontoon sections.

The proportions and dimensions of the hulls and the pontoon frames can be readily designed so that the folded pontoon frame sections, and the deck plates all have essentially identical rectangular dimensions in a ratio of 1 to 2, and in turn, the four parallel pontoon structures when placed parallel, side to side, are of a similar rectangular aspect; thus, the broken down structure can be readily stacked into an essentially rectangular pile having a length to width ratio of 2 to 1.

Other concepts include a pontoon boat comprising of large hulls with a large platform upper deck area. However, due to the relatively large platform size on such a boat makes the boat extremely unwieldy for over-the-road transportation when it becomes necessary to move the boat from one water location to another. Since pontoon boats are typically utilized in bayous and in tidewater wetlands, it is generally necessary to transport the boat over the road to a launching point.

Other disadvantage with the pontoon boat is that it is usually maintained as an entity with certain sections folded inward to reduce dimension, but otherwise remains at full size, or the pontoon is shown as being dissembled into a relatively large number of small parts, all of which must be accounted for and maintained in order to provide for reconstruction of the vessel. In addition, set up time increases in direct proportion to the total number of components involved and the number of joints and interconnections decreases the reliability of the entire structure. In addition, the boat does not provide for sufficiently rigid passenger protection. Since pontoon boats are typically multi-passenger affairs and are often used for families, who will have small children aboard, the nature of the rail structure or containment doors surrounding the platform deck is essential to safety.

Other prior art include multi-hulled boat configurations and outrigger type float mounting construction. In particular, catamaran-type twin-hulled boats with articulated hull suspension enabling the overall beam width of the boat to be narrowed when desired to substantially a single hull configuration.

Numerous innovations for a multi-hulled collapsible vessels have been provided in the prior art that are described as follows. Even though these innovations may be suitable for the specific individual purposes to which they address, they differ from the present invention as hereinafter contrasted.

U.S. Pat. No. 5,184,565, COLLAPSIBLE BOAT, Keith R. Matthews the present invention differs from the this invention in that the present invention involves a multi-hulled vessel with a system of multiple hingedly operated containment doors designed to expand the boat width and provide a protected interior area for living and can also be opened and closed with line requiring no electrical assistance.

U.S. Pat. No. 5,174,232, FRAME FOR INFLATABLE CATAMARAN, Graeme J. Broddy the present invention differs from the this invention in that the present invention involves a multi-hulled vessel with a system of multiple hingedly operated containment doors designed to expand the boat width and provide a protected interior area for living and can also be opened and closed with line requiring no electrical assistance.

U.S. Pat. No. 4,993.340, BOAT STRUCTURE, Orlyn G. Pepper, the present invention differs from the this invention in that the present invention relates to a multi-hulled vessel in which the multiple hingedly operated doors are designed to simply expand and stabilize the boat to a specific width while at the same time providing a protected area for living use.

U.S. Pat. No. 3,593,684, Joseph A. Cogliano, COLLAPSIBLE CATAMARAN, the present invention differs from this invention in that the present invention involves a multi-hulled vessel with a system of multiple hingedly operated containment doors designed to expand the boat width and provide a protected interior area for living and can also be opened and closed with line requiring no electrical assistance.

U.S. Pat. No. 4,406,239, SAILBOATS ESPECIALLY CATAMARANS, Klaus Enzmann, the present invention differs from the above invention in that the mounting of the mast on the front center hinge of the vessel allows the boat to be folded with the rigging in place when not in use. The above invention also differs from the present invention in that the present invention relates to a multi-hulled vessel having multiple hinged operated doors used for expanding and stabilizing the boat to a specific width while at the same time providing a protected area for living use.

U.S. Pat. No. 4,856,446, COLLAPSIBLE FISHING AND/OR LEISURE BOAT, Yves Herard, the present invention differs from this invention in that the present invention relates to a collapsible multi-hulled vessel where the multiple hingedly operated doors and hinged floor panels allow simply expanding and stabilizing of the boat to a specific width while at the same time providing a protected area for living use. The vessel's containment doors are latched by multiple simple over-the-center latches in open or closed positions requiring no bolt-to-nut fastening to secure any element of the vessel.

U.S. Pat. No. 5,042,411, COLLAPSIBLE CATAMARAN SAILBOAT, Ronald G. Krolczyk, the present invention differs from this invention in that the present invention relates to a collapsible multi-hulled vessel where the multiple hingedly operated doors and hinged floor panels allow simply expanding and stabilizing of the boat to a specific width while at the same time providing a protected area for living use. The present invention while opened has foldable base panels hingedly attached to the containment doors between the multiple hulls in lieu of a conventional trampoline for passengers. The present invention is also to have a center cabin. The present invention is collapsible about multiple hinges attached to the multiple hulls for easy storage and transport.

U.S. Pat. No. 3,839,979, COLLAPSIBLE MULTI-CARRIER WIND PROPELLED VEHICLE, George W. Wassell, the present invention differs from this invention in that the mounting of the mast on the front center hinge of the vessel allows the boat to be folded with the mast and rigging in place when not in use. The present invention differs from the above invention in that requires no electrical assistance to expand or contract any element in either its open of closed configuration. The opening and closing can be accomplished with lines.

U.S. Pat. No. 5,277,142, VARIABLE BEAM CATAMARAN, Dennis P. Connor, The present invention differs from the above invention in that the present invention relates to a collapsible multi-hulled vessel where multiple hinged operated doors and hinged floor panels allow for simple expanding and stabilizing of the boat to a specific width while at the same time providing a protected area for living use. The present invention including the mast may be folded without disassembling any parts to reduce the boat width so it can be towed on a trailer and stored in the water or on land in a closed position with the mast and rigging in place. The present invention also differs from the above invention in that the present invention when in the collapsed or folded position does not sacrifice an increase in dimension or size in one direction for a reduction in dimension or size in another direction as evident with the design of the above invention Numerous innovations for multi-hulled vessels have been provided in the prior art that are adapted to be used. Even though these innovations may be suitable for the specific individual purposes to which they address, they would not be suitable for the purposes of the present invention as heretofore described.

SUMMARY OF THE INVENTION

A collapsible multi-hulled vessel according to this invention has a plurality of laterally spaced carriers, such as hulls, skis, skates, or hulls held in space relationship by at least one pair of containment doors pivotally connected at either end to a respective hull. The containment doors are vertically hinged in three places and connected to a center latching mechanism and may be moved axially relative to the carriers to fold the containment doors outwardly to allow sufficient room to collapse the hulls together. The mast and rigging is stepped in the front center of the vessel with the possibility of one or more mast braces connecting to one end of the mast the other end to any respective hull. When the mast is folded down to lie horizontally, it pivots rotatably about the connection to the flotation frame with the mast and rigging intact while forward containment doors collapse forwardly bringing the hulls together.

The present invention relates to a collapsible multi-hulled vessel which is simple to open and close by using a single line requiring no hydraulic or electrical assistance.

A still further object of the present invention to provide for a frame which is secured to both hulls in such a way as to tend to stabilize each against rotation when the craft is in use and still remain a collapsible vessel.

A further object is the provision of a frame which will stay attached to the hulls (whether open or closed) of the collapsible multi-hulled vessel during transport and in particular that can fold while still attached to the hull or hulls bringing them close together for transport or storage.

An additional object of the invention is the provision of a frame which is capable of being used either as a catamaran for turbulent waters or for family recreational boating on calm waters, and which can be powered by a sail, or a motor or oars.

In keeping with these objects, and with others which will become apparent hereinafter, one feature of the present invention resides, briefly stated, in the inherent safety of the vessel by allowing safe operation of the vessel in an open or in a closed position powered under motor.

Accordingly, the present invention relates to providing a collapsible multi-hulled vessel which is strong and light, is easily erected for operation and easily collapsed for transportation and storage.

One feature of the present invention is to provide a frame for a collapsible multi-hulled vessel which can be reduced to a size convenient for transport or storage without complete disassembly, and which can be opened and closed relatively quickly and easily. More particularly, it is an object of the collapsible multi-hulled vessel to allow for reduced boat width so it can be towed on a trailer on highway or opened in water for speed, stability and added usable room.

Another feature of the present invention, calls for the mounting of the mast on the front center hinge of the vessel allowing it to be folded with both the mast and rigging in place.

In accordance with another feature of the present invention, the hinge points and cross sections of the doors allow water resistant seals on all joints.

Another feature of the present invention is that the opening and closing of the collapsible multi-hulled vessel can be accomplished with lines and requires no additional hydraulic or electrical assistance.

Still another feature of the present invention is that a collapsible assembly is disclosed which can be made into or converted into a catamaran, a swamp boat, a sail car, an ice boat, a ski vehicle, a snowmobile, a snow blower (vehicle), a plane, etc.

A further feature provides for an assemblage which is easily and quickly convertible, is comprised of a minimum number of interchangeable parts and is rugged, inexpensive to construct and easily serviceable.

Yet another feature is to provide such an assemblage which can readily be converted and placed onto a trailer. Yet still another feature of the present invention is that lock latching may be accomplished by multiple over-the-center latches in open or closed positions.

Still another feature of the present invention the vessel can function as an emergency lifeboat, tender or pleasure vessel for larger boats. Space may be saved by having a collapsible tender.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

10—collapsible multi-hulled vessel 10
11—stern 11
12—retractable centerboard 12
16—mast 16
18—hulls 18
18A—port hull 18A
18B—starboard hull 18B
18C—starboard hull stern end 18C
18D—port hull stern end 18D
18E—starboard hull bow end 18E
18F—port hull bow end 18F
19—main sail 19
20—boom 20
22—collapsible starboard member 22
22A—starboard side collapsible member stern containment door to collapsible member starboard side member folding hinge stern support 22A
22B—port side collapsible member stern containment door to collapsible member port side member folding hinge stern support 22B
22C—starboard side collapsible member stern containment door 22C
22D—port side collapsible member stern containment door 22D
22E—starboard side collapsible member stern containment door hinge support
22F—port side collapsible member stern containment door hinge support
22G—collapsible member stern-to-bow main folding hinge 22G
22H—port side collapsible member bow containment door 22H
22I—starboard side collapsible member bow containment door 22I
22J—starboard side collapsible member bow containment door hinge support
22K—port side collapsible member bow containment door hinge support
22L—starboard hull bottom-to-port collapsible member bottom panel hinge 22L
22L1—port hull bottom-to-port collapsible member bottom panel hinge 22L1
22M—collapsible member stern-to-bow main folding hinge bow support and latching mechanism 22M
22N—collapsible member stern-to-bow main folding hinge stern support and latching mechanism 22N
22O—starboard side collapsible member stern containment door window 22O
22P—port side collapsible member stern containment door window 22P
22Q—collapsible member port side folding bottom panel 22Q
22R—collapsible member starboard side folding bottom panel 22R
22U—collapsible member inside of starboard hull 22U
22V—collapsible member inside of port hull 22V
22W—port side collapsible member stern containment door to collapsible member port side member folding hinge bow support and latching mechanism 22W
22X—starboard side collapsible member stern containment door to collapsible member starboard side member folding hinge bow support and latching mechanism 22X
24—trailer 24
24A—trailer hitch coupler 24A
24B—trailer mast forward support 24B
24C—trailer mast support mast containment holder 24C
24D—trailer straight support tounge 24D
24E—trailer frame member 24E
24F—a plurality of trailer wheels 24F
24G—a plurality of trailer wheel guards 24G
24H—trailer mast rear support 24H
24I—trailer lateral support guides 24I
24J—port hull trailer support member 24J
24K—starboard hull trailer support member 24K
26—storage unit 26
28—cabin 28
28A—cabin stern port door 28A
28B—cabin stern middle door 28B
28C—cabin stern port door 28C
28D—cabin stern port door window 28D
28E—cabin stern middle door window 28E
28F—cabin stern starboard door window 28F
28G—port side collapsible member bow containment door window 28G p0 28H—port side collapsible member bow containment door window 28H

DETAILED LIST OF REFERENCE NUMERAL UTILIZED IN THE DRAWING

10—collapsible multi-hulled vessel 10 comprising: a stern 11; port and starboard retractable centerboard 12; a mast 16; a hull 18; a main sail 19; a boom 20; a collapsible member 22; and a cabin 28.

11—stern 11 positioned at the rear distal end of said hull 18

12—retractable centerboard 12 with a distal end protruding perpendicularly downwardly from said hull 18 forward of said stern 11 and a pivoted end attached to said collapsible multi-hulled vessel 10

16—mast 16 with a distal end protruding perpendicularly upward from said collapsible member stern to bow main folding hinge bow support and latching mechanism 22M forward of said stern 11 and a rotatably fixed end attached to said collapsible multi-hulled vessel 10 having a boom 20 perpendicularly attached to said mast 16 stretching from said rotatably fixed end of said mast 16 aft toward said stern 11 with a main sail 19 affixed to and between said mast 16 and to said boom 20 for capturing wind necessary for propelling the vessel through the water.

18—hull 18 providing sufficient buoyancy for said collapsible multi-hulled vessel 10

18A—port hull 18A floating said collapsible multi-hulled vessel 10 with port hull 18A promoting lateral stability while at the same time reducing forward water resistance attached to said hull 18.

18B—starboard hull 18B floating said collapsible multi-hulled vessel 10 with starboard hull 18B promoting lateral stability while at the same time reducing forward water resistance, attached to said hulls 18.

20—boom 20 being connected to sail 19 and mast 16 functioning to maintain tension on said sail 19

22—collapsible member 22 comprising: starboard side collapsible member stern containment door to collapsible member starboard side member folding hinge stern support 22A, port side collapsible member stern containment door to collapsible member port side member folding hinge stern support 22B, port side collapsible member stern containment door 22C, port side collapsible member stern containment door 22D, port side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, port side collapsible member bow containment door hinge support 22J, port side collapsible member bow containment door hinge support and latching mechanism 22K, starboard hull bottom-to-starboard collapsible member bottom, panel hinge 22L, port hull bottom-to-port collapsible member bottom panel, hinge 22L1, collapsible member stern-to-bow main folding hinge bow support 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member port side folding bottom panel 22R

22A—starboard side collapsible member stern containment door to collapsible member starboard side member folding hinge stern support 22A having a starboard side collapsible member stern containment door 22C vertically hingedly positioned to starboard side collapsible member stern containment door to collapsible member starboard side member folding hinge stern support and latching mechanism 22A, further connected to a starboard side collapsible member stern containment door hinge support 22E vertically hingedly connecting starboard side collapsible member stern containment door 22C to collapsible member starboard side folding bottom panel 22R, hingedly functioning to allow starboard side rearward vertical containment of an open cockpit being formed between starboard side collapsible member stern containment door 22C, collapsible member stern-to-bow main folding hinge 22G and collapsible member starboard side member 22R.

22B—port side collapsible member stern containment door to collapsible member starboard side member folding hinge stern support and latching mechanism 22B having a port side collapsible member stern containment door 22D vertically hingedly positioned to port side collapsible member stern containment door to collapsible member starboard side member folding hinge stern support 22B, further connected to a port side collapsible member stern containment door hinge support 22F vertically hingedly connecting port side collapsible member stern containment door 22D to collapsible member port side folding bottom panel 22Q, hingedly functioning to allow port side rearward vertical containment of an open cockpit being formed between port side collapsible member stern containment door 22D, collapsible member stern-to-bow main folding hinge 22G, and collapsible member port side member 22Q.

22C—starboard side collapsible member stern containment door 22C having a starboard side collapsible member stern containment door hinge support and latching mechanism 22E positioned at an inward distal end vertically hingedly connecting said starboard side collapsible member stern containment door 22C and connected to collapsible member stern-to-bow main folding hinge stern support 22N at an opposite distal end, further connected to said starboard side collapsible member stern containment door to collapsible member starboard side member folding hinge stern support and latching mechanism 22A, functioning to provide a rearward vertical containment of an open cockpit being formed between starboard side collapsible member stern containment door 22C, port side collapsible member stern containment door 22D, starboard side collapsible member stern containment door to collapsible member starboard side member folding hinge stern support and latching mechanism 22A, port side collapsible member stern containment door to collapsible member 22B, starboard side collapsible member bow containment door 22I, and port side collapsible member bow containment door 22H.

22D—port side collapsible member stern containment door 22D having a port side collapsible member stern containment door hinge support 22F positioned at an inward distal end vertically hingedly connecting said port side collapsible member stern containment door 22D and connected to collapsible member stern-to-bow main folding hinge stern support 22N at an opposite distal end, further connected to said port side collapsible member stern containment door to collapsible member starboard side member folding hinge stern support 22B functioning to provide a rearward vertical containment of an open cockpit being formed between port side collapsible member stern containment door 22D, starboard side collapsible member stern containment door 22C, starboard side collapsible member stern containment door to collapsible member starboard side member folding hinge stern support 22A, port side collapsible member stern containment door to collapsible member 22B, starboard side collapsible member bow containment door 22I, and port side collapsible member bow containment door 22H.

22E—starboard side collapsible member stern containment door hinge support and latching mechanism 22E having a starboard side collapsible member stern containment door 22C hingedly attached about starboard side collapsible member stern containment door hinge support 22E, further hingedly connected to rear distal end of starboard hull bottom-to-starboard collapsible member bottom panel hinge 22L, further hingedly connected to rear distal edge of collapsible member starboard side member 22R, functioning to provide a fixed point of rotation for collapsing and opening said collapsible multi-hulled vessel 10 about hingedly connected starboard side collapsible member stern containment door 22C, starboard side collapsible member stern containment door hinge support 22E, starboard hull bottom-to-starboard collapsible member bottom panel hinge 22L, collapsible member starboard side member 22R.

22F—port side collapsible member stern containment door hinge support 22F having a port side collapsible member stern containment door 22D hingedly attached about port side collapsible member stern containment door hinge support 22F, further hingedly connected to distal end port hull bottom-to-port collapsible member bottom panel hinge 22L1, further hingedly connected to distal edge of collapsible member port side member 22Q, functioning to provide a fixed point of rotation for collapsing and opening said collapsible multi-hulled vessel 10 about hingedly connected port side collapsible member stern containment door 22D, port side collapsible member stern containment door hinge support 22F, port hull bottom-to-port collapsible member bottom panel hinge 22L, collapsible member port side member 22Q.

22G—collapsible member stern-to-bow main folding hinge 22G having a collapsible member port side member 22Q horizontally hingedly connected to collapsible member stern-to-bow main folding hinge 22G, further horizontally hingedly connected to collapsible member starboard side member 22R, further vertically connected at a distal forward end to collapsible member stern-to-bow main folding hinge bow support and latching mechanism 22M, further vertically connected at a distal rearward end to collapsible member stern-to-bow main folding hinge stern support 22N, functioning to allow the collapsible multi-hulled vessel to fold inwardly about said collapsible member stern-to-bow main folding hinge 22G while simultaneously allowing said starboard side collapsible member stern containment door 22C, port side collapsible member stern containment door 22D, port side collapsible member bow containment door 22H, starboard side collapsible member bow containment door 22I to expand outwardly allowing said port hull 18A and said starboard hull 18B to move axially toward each other thereby collapsing said collapsible multi-hulled vessel 10.

22H—port side collapsible member bow containment door 22H having a port side collapsible member bow containment door hinge support 22K positioned at an inward distal end vertically hingedly connecting said port side collapsible member bow containment door 22H and connected to collapsible member stern-to-bow main folding hinge bow support and latching mechanism 22M at an opposite distal end, further connected to said port side collapsible member bow containment door to collapsible member port side member folding hinge bow support and latching mechanism 22W, functioning to provide a forward vertical containment of an open cockpit being formed between port side collapsible member bow containment door 22H, starboard side collapsible member bow containment door 22I, port side collapsible member bow containment door to collapsible member starboard side member folding hinge bow support and latching mechanism 22W, starboard side collapsible member bow containment door to collapsible member 22X, starboard side collapsible member stern containment door 22C, and port side collapsible member stern containment door 22D.

22I—starboard side collapsible member bow containment door 22I having a starboard side collapsible member bow containment door hinge support 22J positioned at an inward distal end vertically hingedly connecting said starboard side collapsible member bow containment door 22I and connected to collapsible member stern-to-bow main folding hinge bow support and latching mechanism 22M at an opposite distal end, further connected to said starboard side collapsible member bow containment door to collapsible member starboard side member folding hinge bow support and latching mechanism 22X, functioning to provide a forward vertical containment of an open cockpit being formed between starboard side collapsible member bow containment door 22I, port side collapsible member bow containment door 22H, starboard side collapsible member bow containment door to collapsible member starboard side member folding hinge bow support and latching mechanism 22X, port side collapsible member bow containment door to collapsible member 22W, starboard side collapsible member stern containment door 22C, and port side collapsible member stern containment door 22D.

22J—starboard side collapsible member bow containment door hinge support 22J having a starboard side collapsible member bow containment door 22I hingedly attached about starboard side collapsible member bow containment door hinge support 22J, further hingedly connected to forward distal end of starboard hull bottom-to-starboard collapsible member bottom panel hinge 22L, further hingedly connected to forward distal edge of collapsible member starboard side member 22R, functioning to provide a fixed point of rotation for collapsing and opening said collapsible multi-hulled vessel 10 about hingedly connected starboard side collapsible member bow containment door 22I, starboard side collapsible member bow containment door hinge support 22J, starboard hull bottom-to-starboard collapsible member bottom panel hinge 22L, collapsible member starboard side member 22R.

22K—port side collapsible member bow containment door hinge support and latching mechanism 22K having a port side collapsible member bow containment door 22H hingedly attached about port side collapsible member bow containment door hinge support 22K, further hingedly connected to forward distal end of port hull bottom-to-port collapsible member bottom panel hinge 22L1, further hingedly connected to forward distal edge of collapsible member port side member 22Q, functioning to provide a fixed point of rotation for collapsing and opening said collapsible multi-hulled vessel 10 about hingedly connected port side collapsible member bow containment door 22H, port side collapsible member bow containment door hinge support 22K, port hull bottom-to-port collapsible member bottom panel hinge 22L1, collapsible member port side member 22Q.

22L1—port hull bottom-to-port collapsible member bottom panel hinge 22L1 having a port side collapsible member stern containment door to collapsible member starboard side member folding hinge stern support and latching mechanism 22B attached horizontally perpendicular and extending inwardly to the rear distal end of port hull bottom-to-port collapsible member bottom panel hinge 22L1 connecting to the rear distal end of collapsible member stern-to-bow main folding hinge 22G, further connecting to a port side collapsible member bow containment door to collapsible member port side member folding hinge stern support and latching mechanism 22W attached horizontally perpendicular and extending inwardly to the forward distal end of port hull bottom-to-port collapsible member bottom panel hinge 22L1 connecting to the forward distal end of collapsible member stern-to-bow main folding hinge 22G, functioning to allow said port hull 18A to collapse inwardly toward and about collapsible member stern-to-bow main folding hinge 22G.

22L—starboard hull bottom-to-starboard collapsible member bottom panel hinge 22L having a starboard side collapsible member stern containment door to collapsible member starboard side member folding hinge stern support 22A attached horizontally perpendicular and extending inwardly to the rear distal end of starboard hull bottom-to-starboard collapsible member bottom panel hinge 22L connecting to the rear distal end of collapsible member stern-to-bow main folding hinge 22G, further connecting to a starboard side collapsible member bow containment door to collapsible member starboard side member folding hinge stern support 22X attached horizontally perpendicular and extending inwardly to the forward distal end of starboard hull bottom-to-starboard collapsible member bottom panel hinge 22L connecting to the forward distal end of collapsible member stern-to-bow main folding hinge 22G, functioning to allow said starboard hull 18B to collapse inwardly toward and about collapsible member stern- to-bow main folding hinge 22G.

22M—collapsible member stern-to-bow main folding hinge bow support and latching mechanism 22M being hingably connected to port side collapsible member bow containment door 22H and starboard side collapsible member bow containment door 22I functioning to allow the outward movement of said port side collapsible member bow containment door 22H and starboard side collapsible member bow containment door 22I

22N—collapsible member stern-to-bow main folding hinge stern support and latching mechanism 22N being hingably connected to port side collapsible member stern containment door 22C and starboard side collapsible member stern containment door 22D functioning to allow the outward movement of said port side collapsible member stern containment door 22C and starboard side collapsible member stern containment door 22D

22O—starboard side collapsible member stern containment door window 22O located within said port side collapsible member stern containment door 22C permitting a person positioned within said compartment to view outwardly

22P—port side collapsible member stern containment door window 22P located within said starboard side collapsible member stern containment door 22D permitting a person positioned within said compartment to view outwardly

22Q—collapsible member port side folding bottom panel 22Q being hingedly connected along an port longitudinal end by port hull bottom-to-port collapsible member bottom panel hinge 22L1, hingedly connected along a middle longitudinal end by collapsible member stern-to-bow main folding hinge 22G, securely fastened at a bow distal end to port side collapsible member bow containment door 22H, and securely fastened at a stern distal end to port side collapsible member stern containment door 22D functioning as a platform for said compartment

22R—collapsible member starboard side member 22R having a collapsible member stern-to-bow main folding hinge 22G longitudinally located at a middle distal end connecting said collapsible member stern-to-bow main folding hinge 22G to port side collapsible member stern containment door to collapsible member 22A, further having a starboard hull bottom-to-starboard collapsible member bottom panel hinge 22L located at an opposite longitudinal distal end connecting said collapsible member starboard side member 22A to a port hull 18B, further having a starboard side collapsible member bow containment door 22I located at a front distal end, and lastly having a starboard side collapsible member stern containment door 22C located at a rear distal end, said collapsible member starboard side member 22B functioning as a horizontal support platform connecting a port hull 18A to a starboard hull 18B

22U—collapsible member inside of starboard hull 22U being hingably longitudinally connected to collapsible member port side member 22R by port hull bottom-to-port collapsible member bottom panel hinge 22L

22V—collapsible member inside of port hull 22V being hingably longitudinally connected to collapsible member port side member 22Q by port hull bottom-to-port collapsible member bottom panel hinge 22L1

22W—port side collapsible member bow containment door to collapsible member port side member folding hinge bow support and latching mechanism 22W having a port side collapsible member bow containment door 22H vertically hingedly positioned to port side collapsible member bow containment door to collapsible member port side member folding hinge bow support and latching mechanism 22W, further connected to a port side collapsible member bow containment door hinge support 22M vertically hingedly connecting port side collapsible member bow containment door 22H to collapsible member port side folding bottom panel 22Q, hingedly functioning to allow port side rearward vertical containment of an open compartment being formed between port side collapsible member bow containment door 22H, collapsible member stern-to-bow main folding hinge 22G, and collapsible member port side member 22Q

22X—starboard side collapsible member stern containment door to collapsible member starboard side member folding hinge bow support and latching mechanism 22X and latching mechanism having a starboard side collapsible member bow containment door 22I vertically hingedly positioned to starboard side collapsible member bow containment door to collapsible member starboard side member folding hinge bow support and latching mechanism 22X, further connected to a starboard side collapsible member bow containment door hinge support and latching mechanism 22M vertically hingedly connecting starboard side collapsible member bow containment door 22H to collapsible member starboard side folding bottom panel 22R, hingedly functioning to allow starboard side rearward vertical containment of an open compartment being formed between starboard side collapsible member bow containment door 22I, collapsible member stern-to-bow main folding hinge 22G, and collapsible member starboard side member 22R

24—trailer 24 comprising: trailer hitch coupler 24A, trailer mast forward support 24B, trailer mast support mast containment holder 24C, trailer mast support mast containment wedge 24C, trailer straight support member 24D, trailer Frame member 24E, a plurality of trailer wheels 24F, a plurality of trailer wheel guards 24G, trailer mast rear support 24H, trailer lateral support guides 24I, starboard hull trailer support member 24J, and port hull trailer support member 24K

24A—trailer hitch coupler 24A connected to trailer straight support tounge 24D functioning to attach said trailer 24 to a vehicle for transport

24B—trailer mast forward support 24B connected to trailer straight support member 24D at a lower distal end and to trailer mast support mast containment wedge 24C at an upper distal end

24C—trailer mast support mast containment holder 24C connected to trailer mast forward support 24B functioning to support mast 16 during transport

24D—trailer straight support tounge 24D connected at a front distal end to trailer hitch coupler 24A and at a rear distal end to trailer Frame member 24E having trailer mast forward support 24B mounted thereon

24E—trailer Frame member 24E connected at a front distal end trailer straight support member 24D and connected at a rear distal end to starboard hull trailer support member 24J and port hull trailer support member 24K

24F—a plurality of trailer wheels 24F connected to an axial securely mounted to starboard hull trailer support member 24J and port hull trailer support member 24K

24G—plurality of trailer wheel guards 24G securely mounted on starboard hull trailer support member 24J and port hull trailer support member 24H—trailer mast rear support 24H securely mounted upon starboard hull trailer support member 24J and port hull trailer support member 24K

24I—trailer lateral support guides 24I securely mounted upon starboard hull trailer support member 2 4J and port hull trailer support member 24K

24J—starboard hull trailer support member 24J connected at a front distal end to trailer Frame member 24E and securely fastened to plurality of trailer wheel guards 24G and trailer lateral support guides 24I

24K—port hull trailer support member 24K connected at a front distal end to trailer Frame member 24E and securely fastened to plurality of trailer wheel guards 24G and trailer lateral support guides 24I

26—storage unit 26 for storing said collapsible multi-hulled vessel 10 therein

28—cabin 28 mounted upon port hull 18A, starboard hull 18B, starboard side collapsible member bow containment door 22I and port side collapsible member bow containment door 22H functioning to provide water resistant containment therein

28A—cabin stern port door 28A mounted at a bottom distal end to collapsible member starboard side member 22R and at a top distal end to cabin 28, removable water resistant seal attached to cabin stern middle door 28B at a middle distal end and removable water resistant seal attached to port hull 18A at a port distal end

28B—cabin stern middle door 28B slidably mounted at a bottom distal end to collapsible member starboard side member 22R and collapsible member port side member 22Q and at a top distal end to cabin 28, removable water resistant sealing attached to cabin stern starboard door 28A and cabin stern port door 28C at starboard and port distal ends, respectively

28C—cabin stern starboard door 28C mounted at a bottom distal end to collapsible member starboard side member 22R and at a top distal end to cabin 28, removable water resistant seal attached to cabin stern middle door 28B at a middle distal end and removable water resistant seal latched to starboard hull 18B at a starboard distal end

28D—cabin stern port door window 28D contained within cabin stern port door 28A allowing viewing outwardly from said cabin 28

28E—cabin stern middle door window 28E contained within cabin stern middle door 28B allowing viewing outwardly from said cabin 28

28F—cabin stern starboard door window 28F contained within cabin stern starboard door 28C allowing viewing outwardly from said cabin 28

28G—starboard side collapsible member bow containment door window 28G contained within said cabin 28 allowing viewing outwardly from said cabin 28

28H—port side collapsible member bow containment door window 28H contained within said cabin 28 allowing viewing outwardly from said cabin 28

BRIEF DESCRIPTION OF PREFERRED EMBODIMENT

FIG. 9 is a diagrammatic representation exhibiting the method of collapsing said invention.

DETAILED DESCRIPTION OF THE PREFERRED EMBODIMENT

Figure 1:
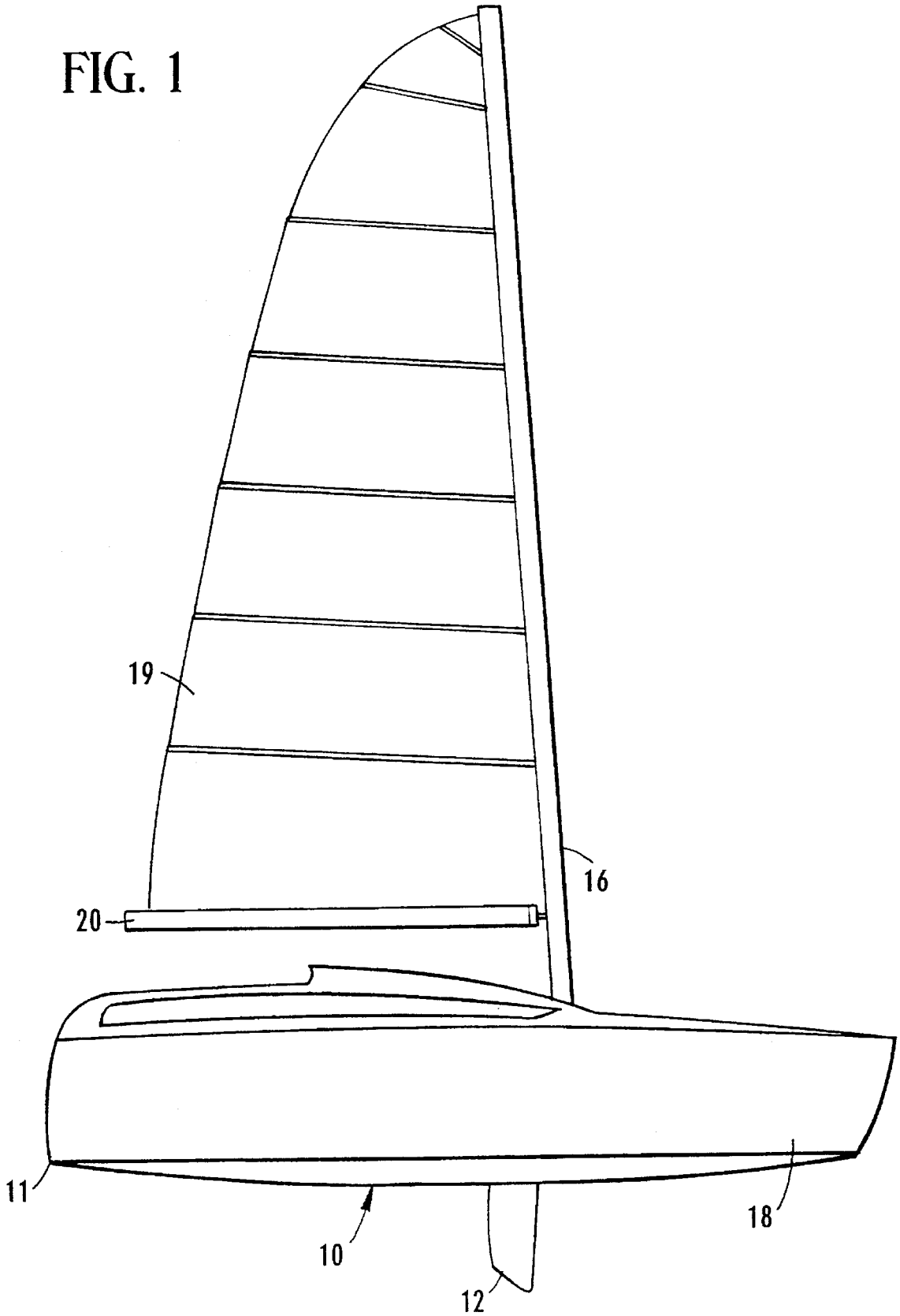
FIG. 1 is a side view of the collapsible multi-hulled vessel.

Firstly, referring to FIG. 1 which is a side view of the collapsible multi-hulled vessel exhibiting the following features: collapsible multi-hulled vessel 10 comprising: a stern 11; a retractable centerboard 12; a mast 16; a hull 18; a main sail 19; a boom 20; a collapsible member 22; and a cabin 28; stern 11 positioned at the rear distal end of said hull 18; retractable centerboard 12 with a distal end protruding perpendicularly downwardly from said hull 18 forward of said stern 11 and a fixed end attached to said collapsible multi-hulled vessel 10; mast 16 with a distal end protruding perpendicularly upward from said hull 18 forward of said stern 11 and a rotatably fixed end attached to said collapsible multi-hulled vessel 10 having a boom 20 perpendicularly attached to said mast 16 stretching from said rotatably fixed end of said mast 16 aft toward said stern 11 with a main sail 19 affixed to and between said mast 16 and to said boom 20 for capturing wind necessary for propelling the vessel through the water; hull 18 providing sufficient buoyancy for said collapsible multi-hulled vessel 10; and boom 20 connected to mast 16 and sail 19 providing tension on sail 19.

Figure 2:
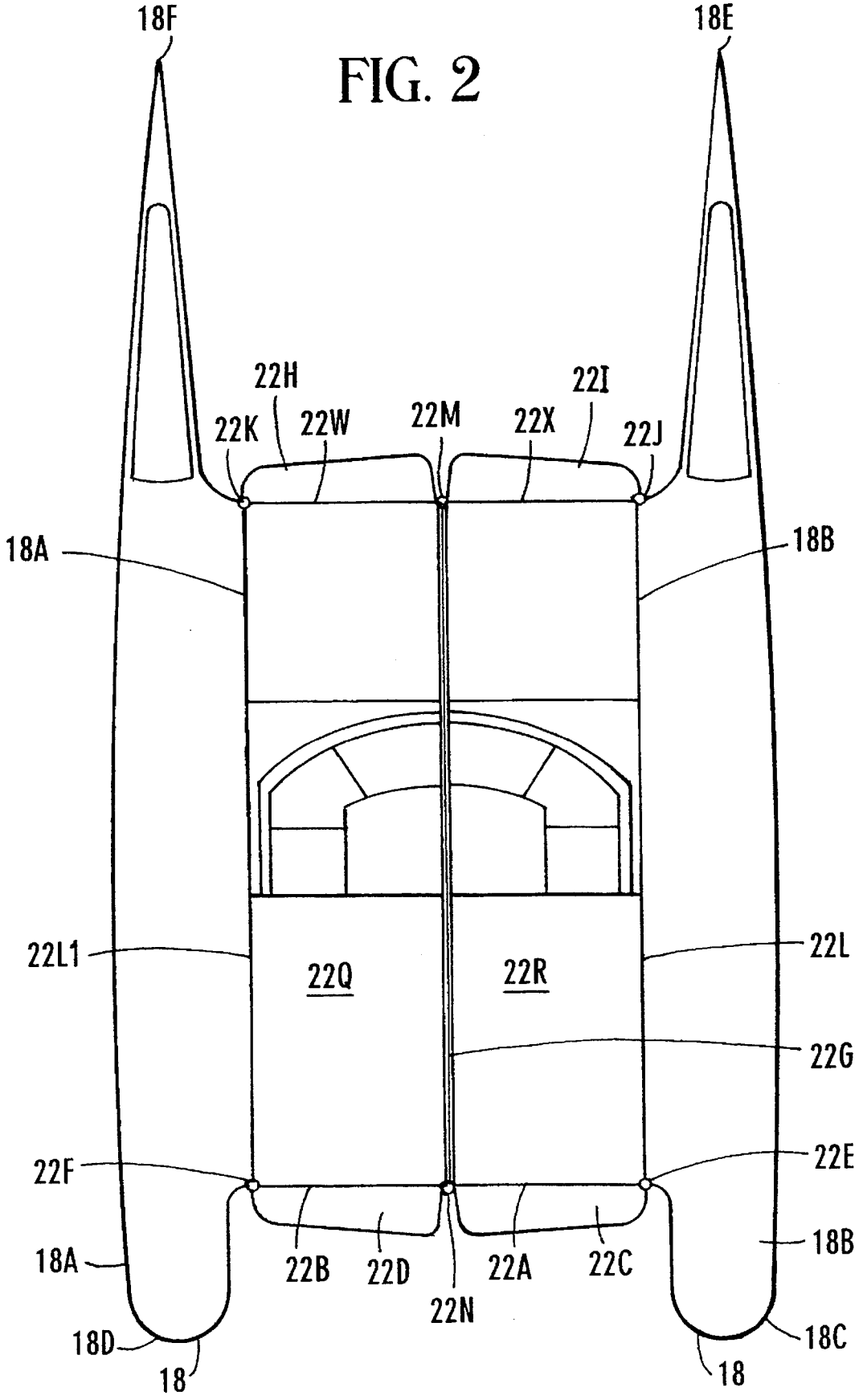
FIG. 2 is a top view of a collapsible multi hulled vessel in fully expanded position.

Now, referring to FIG. 2 which is a top view of a collapsible multi hulled vessel in fully expanded position exhibiting the following features: hull 18 providing sufficient buoyancy for said collapsible multi-hulled vessel 10; port hull 18A floating said collapsible multi-hulled vessel 10; starboard hull 18B floating said collapsible multi-hulled vessel 10, attached to said hull 18; boom 20 being connected to sail 19 and mast 16 functioning to maintain tension on said sail 19; collapsible member 22 comprising: starboard side collapsible member stern containment door to collapsible member starboard side member folding hinge stern support and latching mechanism 22A, port side collapsible member stern containment door to collapsible member starboard side member folding hinge stern support and latching mechanism 22B, starboard side collapsible member stern containment door 22C, port side collapsible member stern containment door 22D, starboard side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge support 22K, port hull bottom-to-port collapsible member bottom, panel hinge 22L1, starboard hull bottom-to-starboard collapsible member bottom panel hinge 22L, collapsible member stern-to-bow main folding hinge bow support and latching mechanism 22M, collapsible member stern-to-bow main folding hinge stern support and latching mechanism 22N, port side collapsible member stern containment door window 22O, port side collapsible member stern containment door window 22P, collapsible member port side folding bottom panel 22Q, collapsible member starboard side folding bottom panel 22R, member inside of port hull 22U, starboard side collapsible member stern containment door to collapsible member starboard side member folding hinge stern support and latching mechanism 22A, port side collapsible member stern containment door to collapsible member starboard side member folding hinge stern support and latching mechanism 22B, starboard side collapsible member stern containment door 22C, port side collapsible member stern containment door 22D, starboard side collapsible, member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge support 22K, port hull bottom-to-port collapsible member bottom panel hinge 22L1, starboard hull bottom-to-starboard collapsible member bottom panel hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, member inside of starboard hull 22U, member inside of port hull 22V; starboard side collapsible member stern containment door to collapsible member starboard side member folding hinge stern support and latching mechanism 22A having a starboard side collapsible member stern containment door 22C vertically hingedly positioned to starboard side collapsible member stern containment door to collapsible member starboard side member folding hinge stern support and latching mechanism 22A, further connected to a starboard side collapsible member stern containment door hinge support 22E vertically hingedly connecting starboard side collapsible member stern containment door 22C to collapsible member starboard side folding bottom panel 22R, hingedly functioning to allow starboard side rearward vertical containment of an open cockpit being formed between starboard side collapsible member stern containment door 22C, collapsible member stern-to-bow main folding hinge 22G and collapsible member starboard side member 22R; port side collapsible member stern containment door to collapsible member starboard side member folding hinge stern support and latching mechanism 22B having a port side collapsible member stern containment door 22D vertically hingedly positioned to port side collapsible member stern containment door to collapsible member starboard side member folding hinge stern support and latching mechanism 22B, further connected to a port side collapsible member stern containment door hinge support 22F vertically hingedly connecting port side collapsible member stern containment door 22D to collapsible member port side folding bottom panel 22Q, hingedly functioning to allow port side rearward vertical containment of an open cockpit being formed between port side collapsible member stern containment door 22D, collapsible member stern-to-bow main folding hinge 22G, and collapsible member port side member 22Q; starboard side collapsible member stern containment door 22C having a starboard side collapsible member stern containment door hinge support 22E positioned at an inward distal end vertically hingedly connecting said starboard side collapsible member stern containment door 22C and connected to collapsible member stern-to-bow main folding hinge stern support and latching mechanism 22N at an opposite distal end, further connected to said starboard side collapsible member stern containment door to collapsible member starboard side member folding hinge stern support and latching mechanism 22A, functioning to provide a rearward vertical containment of an open cockpit being formed between starboard side collapsible member stern containment door 22C, port side collapsible member stern containment door 22D, starboard side collapsible member stern containment door to collapsible member starboard side member folding hinge stern support and latching mechanism 22A, port side collapsible member stern containment door to collapsible member 22B, starboard side collapsible member bow containment door 22I, and port side collapsible member bow containment door 22H; port side collapsible member stern containment door 22D having a port side collapsible member stern containment door hinge support 22F positioned at an inward distal end vertically hingedly connecting said port side collapsible member stern containment door 22D and connected to collapsible member stern-to-bow main folding hinge stern support and latching mechanism 22N at an opposite distal end, further connected to said port side collapsible member stern containment door to collapsible member starboard side member folding hinge stern support and latching mechanism 22B functioning to provide a rearward vertical containment of an open cockpit being formed between port side collapsible member stern containment door 22D, starboard side collapsible member stern containment door 22C, starboard side collapsible member stern containment door to collapsible member starboard side member folding hinge stern support and latching mechanism 22A, port side collapsible member stern containment door to collapsible member port side member folding hinge support and latching mechanism 22B, starboard side collapsible member bow containment door 22I, and port side collapsible member bow containment door 22; starboard side collapsible member stern containment door hinge support 22E having a starboard side collapsible member stern containment door 22C hingedly attached about starboard side collapsible member stern containment door hinge support 22E, further hingedly connected to rear distal end of starboard hull bottom-to-starboard collapsible member bottom panel hinge 22L, further hingedly connected to rear distal edge of collapsible member starboard side member 22R, functioning to provide a fixed point of rotation for collapsing and opening said collapsible multi-hulled vessel 10 about hingedly connected starboard side collapsible member stern containment door 22C, starboard side collapsible member stern containment door hinge support 22E, starboard hull bottom-to-starboard collapsible member bottom panel hinge 22L, collapsible member starboard side member 22R; port side collapsible member stern containment door hinge support 22F having a port side collapsible member stern containment door 22D hingedly attached about port side collapsible member stern containment door hinge support 22F, further hingedly connected to distal end port hull bottom-to-port collapsible member bottom panel hinge 22L1, further hingedly connected to distal edge of collapsible member port side member 22Q, functioning to provide a fixed point of rotation for collapsing and opening said collapsible multi-hulled vessel 10 about hingedly connected port side collapsible member stern containment door 22D, port side collapsible member stern containment door hinge support 22F, port hull bottom-to-port collapsible member bottom panel hinge 22L1, collapsible member port side member 22Q; collapsible member stern-to-bow main folding hinge 22G having a collapsible member port side member 22Q horizontally hingedly connected to collapsible member stern-to-bow main folding hinge 22G, further horizontally hingedly connected to collapsible member starboard side member 22R, further vertically connected at a distal forward end to collapsible member stern-to-bow main folding hinge bow support and latching mechanism 22N, further vertically connected at a distal rearward end to collapsible member stern-to-bow main folding hinge stern support and latching mechanism 22N, functioning to allow the collapsible multi-hulled vessel to fold inwardly about said collapsible member stern-to-bow main folding hinge 22G while simultaneously allowing said starboard side collapsible member stern containment door 22C, port side collapsible member stern containment door 22D, starboard side collapsible member bow containment door 22H, starboard side collapsible member bow containment door 22I to expand outwardly allowing said port hull 18A and said starboard hull 18B to move axially toward each other thereby collapsing said collapsible multi-hulled vessel 10; starboard side collapsible member bow containment door 22H having a starboard side collapsible member bow containment door hinge support 22K positioned at an inward distal end vertically hingedly connecting said starboard side collapsible member bow containment door 22H and connected to collapsible member stern-to-bow main folding hinge bow support and latching mechanism 22M at an opposite distal end, further connected to said starboard side collapsible member bow containment door to collapsible member starboard side member folding hinge bow support and latching mechanism 22X, functioning to provide a forward vertical containment of an open cockpit being formed between starboard side collapsible member bow containment door 22H, starboard side collapsible member bow containment door 22I, starboard side collapsible member bow containment door to collapsible member starboard side member folding hinge bow starboard 22X, port side collapsible member bow containment door to collapsible member 22W, starboard side collapsible member stern containment door 22C, and port side collapsible member stern containment door 22D; starboard side collapsible member bow containment door 22I having a starboard side collapsible member bow containment door hinge support 22J positioned at an inward distal end vertically hingedly connecting said starboard side collapsible member bow containment door 22I and connected to collapsible member stern-to-bow main folding hinge bow support and latching mechanism 22M at an opposite distal end, further connected to said starboard side collapsible member bow containment door to collapsible member starboard side member folding hinge bow support 22X, functioning to provide a forward vertical containment of an open cockpit being formed between starboard side collapsible member bow containment door 22I, port side collapsible member bow containment door 22H, starboard side collapsible member bow containment door to collapsible member starboard side member folding hinge bow support and latching mechanism 22X, port side collapsible member bow containment door to collapsible member port side member folding hinge bow support and latching mechanism 22W, starboard side collapsible member stern containment door 22C, and port side collapsible member stern containment door 22D; starboard side collapsible member bow containment door hinge support 22J having a starboard side collapsible member bow containment door 22I hingedly attached about starboard side collapsible member bow containment door hinge support 22J, further hingedly connected to forward distal end of starboard hull bottom-to-starboard collapsible member bottom panel hinge 22L, further hingedly connected to forward distal edge of collapsible member starboard side member 22R, functioning to provide a fixed point of rotation for collapsing and opening said collapsible multi-hulled vessel 10 about hingedly connected starboard side collapsible member bow containment door 22I, starboard side collapsible member bow containment door hinge support 22J, starboard hull bottom-to-starboard collapsible member bottom panel hinge 22L, collapsible member starboard side member 22R; port side collapsible member bow containment door hinge support 22K having a port side collapsible member bow containment door 22H hingedly attached about port side collapsible member bow containment door hinge support 22K, further hingedly connected to forward distal end of port hull bottom-to-port collapsible member bottom panel hinge 22L1, further hingedly connected to forward distal edge of collapsible member port side member 22Q, functioning to provide a fixed point of rotation for collapsing and opening said collapsible multi-hulled vessel 10 about hingedly connected port side collapsible member bow containment door 22H, port side collapsible member bow containment door hinge support 22K, port hull bottom-to-port collapsible member bottom panel hinge 22L1, collapsible member port side member 22Q; starboard hull bottom-to-starboard collapsible member bottom panel hinge 22L having a starboard side collapsible member stern containment door to collapsible member starboard side member folding hinge stern support and latching mechanism 22A attached horizontally perpendicular and extending inwardly to the rear distal end of starboard hull bottom-to-starboard collapsible member bottom panel hinge 22L connecting to the rear distal end of collapsible member stern-to-bow main folding hinge 22G, further connecting to a starboard side collapsible member bow containment door to collapsible member starboard side member folding hinge stern support and latching mechanism 22X attached horizontally perpendicular and extending inwardly to the forward distal end of starboard hull bottom-to-starboard collapsible member bottom panel hinge 22L connecting to the forward distal end of collapsible member stern-to-bow main folding hinge 22G, functioning to allow said starboard hull 18B to collapse inwardly toward and about collapsible member stern-to-bow main folding hinge 22G; port hull bottom-to-port collapsible member bottom panel hinge 22L1 having a port side collapsible member stern containment door to collapsible member starboard side member folding hinge stern support and latching mechanism 22B attached horizontally perpendicular and extending inwardly to the rear distal end of port hull bottom-to-port collapsible member bottom panel hinge 22L1 connecting to the rear distal end of collapsible member stern-to-bow main folding hinge 22G, further connecting to a port side collapsible member bow containment door to collapsible member port side member folding hinge stern support and latching mechanism 22W attached horizontally perpendicular and extending inwardly to the forward distal end of port hull bottom-to-port collapsible member bottom panel hinge 22L1 connecting to the forward distal end of collapsible member stern-to-bow main folding hinge 22G, functioning to allow said port hull 18A to collapse inwardly toward and about collapsible member stern-to-bow main folding hinge 22G; collapsible member stern-to-bow main folding hinge bow support and latching mechanism 22M being hingably connected to starboard side collapsible member bow containment door 22H and starboard side collapsible member bow containment door 22 functioning to allow the outward movement of said collapsible member bow containment door 22H and starboard side collapsible member bow containment door 22I; collapsible member stern-to-bow main folding hinge stern support and latching mechanism 22N being hingably connected to starboard side collapsible member stern containment door 22C and port side collapsible member stern containment door 22D functioning to allow the outward movement of said starboard side collapsible member stern containment door 22C and port side collapsible member stern containment door 22D; starboard side collapsible member stern containment door window 22O located within said starboard side collapsible member stern containment door 22C permitting a person positioned within said compartment to view outwardly; port side collapsible member stern containment door window 22P located within said port side collapsible member stern containment door 22D permitting a person positioned within said compartment to view outwardly; collapsible member port side folding bottom panel 22Q being hingedly connected along an starboard longitudinal end by port hull bottom-to-port collapsible member bottom panel hinge 22L, hingedly connected along a middle longitudinal end by collapsible member stern-to-bow main folding hinge 22G, securely fastened at a bow distal end to starboard side collapsible member bow containment door 22H, and securely fastened at a stern distal end to port side collapsible member stern containment door 22D functioning as a platform for said compartment; collapsible member starboard side member 22R having a collapsible member stern-to-bow main folding hinge 22G longitudinally located at a middle distal end connecting said collapsible member stern-to-bow main folding hinge 22G to port side collapsible member stern containment door to collapsible member port side member folding hinge stern support and latching mechanism 22B, further having a port hull bottom-to-port collapsible member bottom panel hinge 22L1, located at an opposite longitudinal distal end connecting said collapsible member starboard side member folding hinge stern support and latching mechanism 22A to a starboard hull 18B, further having a starboard side collapsible member bow containment door 22I located at a front distal end, and lastly having a starboard side collapsible member stern containment door 22C located at a rear distal end, said collapsible member starboard side member folding hinge support and latching mechanism 22A functioning as a horizontal starboard platform connecting a port hull 18A to a starboard hull 18B; member inside of starboard hull 22U being hingably longitudinally connected to collapsible member starboard side member 22R by port hull bottom-to-port collapsible member bottom panel hinge 22L1; member inside of port hull 22V being hingably longitudinally connected to collapsible member starboard side member 22R by port hull bottom-to-port collapsible member bottom panel hinge 22L1; port side collapsible member bow containment door to collapsible member port side member folding hinge bow support and latching mechanism 22W having a port side collapsible member bow containment door 22H vertically hingedly positioned to port side collapsible member bow containment door to collapsible member port side member folding hinge bow support and latching mechanism 22W, further connected to a port side collapsible member bow containment door hinge support and latching mechanism 22M vertically hingedly connecting port side collapsible member bow containment door 22H to collapsible member port side folding bottom panel 22Q, hingedly functioning to allow port side rearward vertical containment of an open compartment being formed between port side collapsible member bow containment door 22H, collapsible member stern-to-bow main folding hinge 22G, and collapsible member port side member 22Q; starboard side collapsible member stern containment door to collapsible member starboard side member folding hinge bow support and latching mechanism 22X having a starboard side collapsible member bow containment door 22I vertically hingedly positioned to starboard side collapsible member bow containment door to collapsible member starboard side member folding hinge bow support and latching mechanism 22X, further connected to a starboard side collapsible member bow containment door hinge support and latching mechanism 22M vertically hingedly connecting starboard side collapsible member bow containment door 22H to collapsible member starboard side folding bottom panel 22R, hingedly functioning to allow starboard side rearward vertical containment of an open compartment being formed between starboard side collapsible member bow containment door 22I, collapsible member stern-to-bow main folding hinge 22G, and collapsible member starboard side member 22R; port side collapsible member bow containment door window 28G contained within said cabin 28 allowing viewing outwardly from said cabin 28; and starboard side collapsible member bow containment door window 28H contained within said cabin 28 allowing viewing outwardly from said cabin 28.

Figure 3:
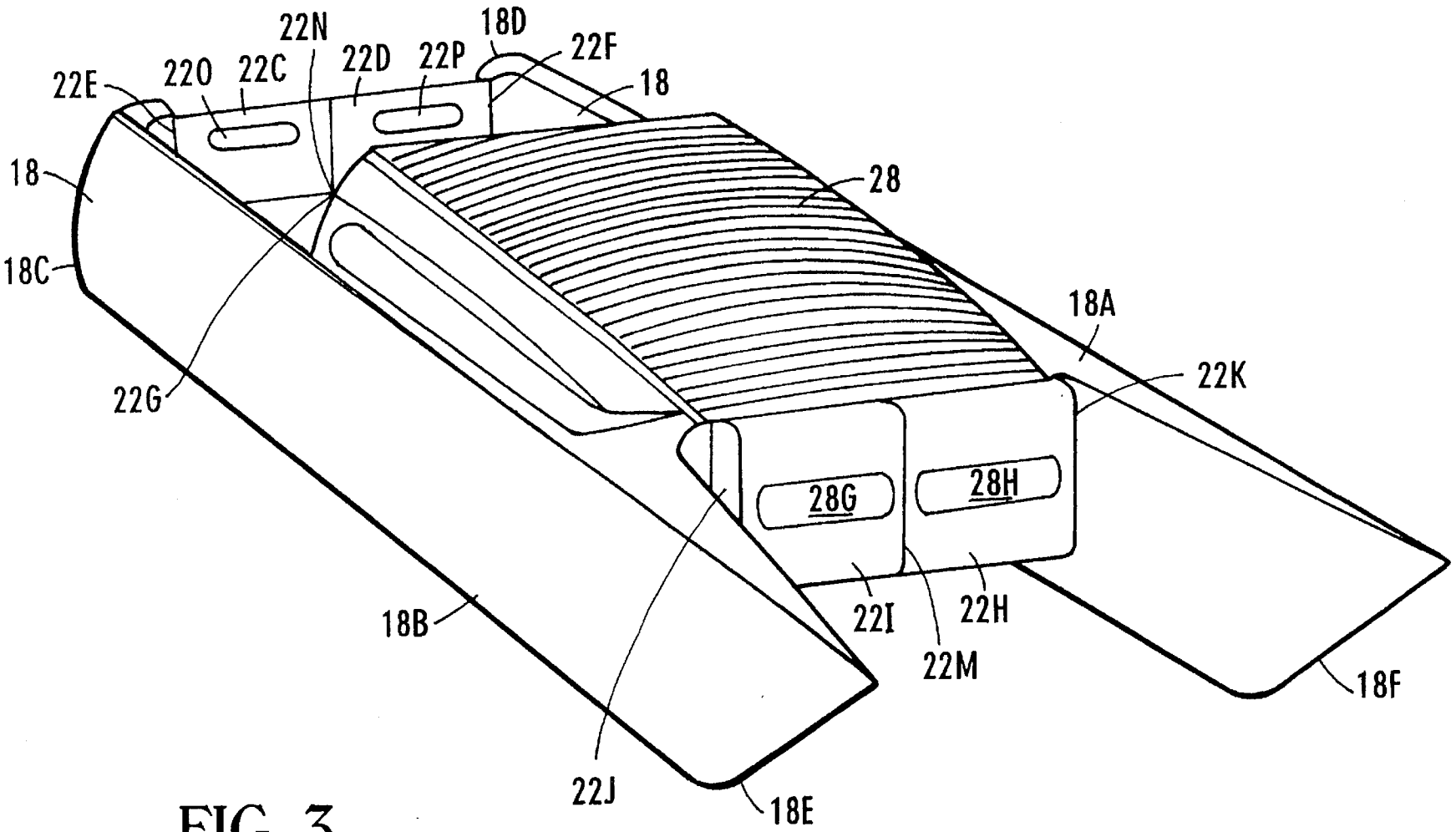
FIG. 3 is a frontal isometric view of the collapsible multi-hulled vessel in fully expanded position having a cabin mounted thereon.

Now, referring to FIG. 3 which is a frontal isometric view of the collapsible multi-hulled vessel in fully expanded position having a cabin mounted thereon exhibiting the following features: hull 18 providing sufficient buoyancy for said collapsible multi-hulled vessel 10; port hull 18A floating said collapsible multi-hulled vessel 10, starboard hull 18B floating said collapsible multi-hulled vessel 10, collapsible member 22 comprising: starboard side collapsible member stern containment door to collapsible member starboard side member folding hinge stern starboard 22A, port side collapsible member stern containment door to collapsible member starboard side member folding hinge stern starboard 22B, starboard side collapsible member stern containment door 22C, port side collapsible member stern containment door 22D, starboard side collapsible member stern containment door hinge starboard 22E, port side collapsible member stern containment door hinge starboard 22F, collapsible member stern-to-bow main folding hinge 22G, port side collapsible member bow containment door 22H, starboard side collapsible member bow containment door 22I, starboard side collapsible member bow containment door hinge starboard 22J, port side collapsible member bow containment door hinge starboard and latching mechanism 22K, port hull bottom-to-port collapsible member bottom, panel hinge 22L1, starboard hull bottom-to-starboard collapsible member bottom panel hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, member inside of port hull 22U, starboard side collapsible member stern containment door to collapsible member starboard side member folding hinge stern starboard 22A, port side collapsible member stern containment door to collapsible member starboard side member folding hinge stern starboard 22B, starboard side collapsible member stern containment door 22C, port side collapsible member stern containment door 22D, starboard side collapsible member stern containment door hinge starboard 22E, port side collapsible member stern containment door hinge 22F, collapsible member stern-to-bow main folding hinge 22G, port side collapsible member bow containment door 22H, starboard side collapsible member bow containment door 22I, starboard side collapsible member bow containment door hinge starboard 22J, port side collapsible member bow containment door hinge starboard 22K, port hull bottom-to-port collapsible member bottom panel hinge 22L1, starboard hull bottom-to-starboard collapsible member bottom panel hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, collapsible member inside of port hull 22U, and collapsible member inside of starboard hull 22V; starboard side collapsible member stern containment door 22C having a starboard side collapsible member stern containment door hinge starboard 22E positioned at an inward distal end vertically hingedly connecting said starboard side collapsible member stern containment door 22C and connected to collapsible member stern-to-bow main folding hinge stern support and latching mechanism 22N at an opposite distal end, further connected to said starboard side collapsible member stern containment door to collapsible member starboard side member folding hinge stern starboard 22A, functioning to provide a rearward vertical containment of an open cockpit being formed between starboard side collapsible member stern containment door 22C, port side collapsible member stern containment door 22D, starboard side collapsible member stern containment door to collapsible member starboard side member folding hinge stern support and latching mechanism 22A, port side collapsible member stern containment door to collapsible port side member folding hinge stern support and latching mechanism 22B, starboard side collapsible member bow containment door 22I, and port side collapsible member bow containment door 22H; port side collapsible member stern containment door 22D having a port side collapsible member stern containment door hinge 22F positioned at an inward distal end vertically hingedly connecting said port side collapsible member stern containment door 22D and connected to collapsible member stern-to-bow main folding hinge stern support and latching mechanism 22N at an opposite distal end, further connected to said port side collapsible member stern containment door to collapsible member starboard side member folding hinge stern support and latching mechanism 22B functioning to provide a rearward vertical containment of an open cockpit being formed between port side collapsible member stern containment door 22D, starboard side collapsible member stern containment door 22C, starboard side collapsible member stern containment door to collapsible member starboard side member folding hinge stern support and latching mechanism 22A, port side collapsible member stern containment door to collapsible member 22B, starboard side collapsible member bow containment door 22I, and port side collapsible member bow containment door 22; starboard side collapsible member stern containment door hinge 22E having a starboard side collapsible member stern containment door 22C hingedly attached about starboard side collapsible member stern containment door hinge 22E, further hingedly connected to rear distal end of starboard hull bottom-to-starboard collapsible member bottom panel hinge 22L, further hingedly connected to rear distal edge of collapsible member starboard side member 22R, functioning to provide a fixed point of rotation for collapsing and opening said collapsible multi-hulled vessel 10 about hingedly connected starboard side collapsible member stern containment door 22C, starboard side collapsible member stern containment door hinge 22E, starboard hull bottom-to-starboard collapsible member bottom panel hinge 22L, collapsible member starboard side member 22R; port side collapsible member stern containment door hinge 22F having a port side collapsible member stern containment door 22D hingedly attached about port side collapsible member stern containment door hinge 22F, further hingedly connected to distal end port hull bottom-to-port collapsible member bottom panel hinge 22L1, further hingedly connected to distal edge of collapsible member port side member 22Q, functioning to provide a fixed point of rotation for collapsing and opening said collapsible multi-hulled vessel 10 about hingedly connected port side collapsible member stern containment door 22D, port side collapsible member stern containment door hinge 22F, port hull bottom-to-port collapsible member bottom panel hinge 22L1, collapsible member port side member 22Q; starboard side collapsible member bow containment door 22H having a starboard side collapsible member bow containment door hinge starboard 22K positioned at an inward distal end vertically hingedly connecting said starboard side collapsible member bow containment door 22H and connected to collapsible member stern-to-bow main folding hinge bow support and latching mechanism 22M at an opposite distal end, further connected to said port side collapsible member bow containment door to collapsible member port side member folding hinge bow support and latching mechanism 22W, functioning to provide a forward vertical containment of an open cockpit being formed between port side collapsible member bow containment door 22H, port side collapsible member bow containment door 22I, port side collapsible member bow containment door to collapsible member port side member folding hinge bow support and latching mechanism 22W, starboard side collapsible member bow containment door to collapsible member 22X, starboard side collapsible member stern containment door 22C, and port side collapsible member stern containment door 22D; starboard side collapsible member bow containment door 22I having a starboard side collapsible member bow containment door hinge starboard 22J positioned at an inward distal end vertically hingedly connecting said starboard side collapsible member bow containment door 22I and connected to collapsible member stern-to-bow main folding hinge bow support and latching mechanism 22M at an opposite distal end, further connected to said starboard side collapsible member bow containment door to collapsible member starboard side member folding hinge bow support and latching mechanism 22X, functioning to provide a forward vertical containment of an open cockpit being formed between starboard side collapsible member bow containment door 22I, port side collapsible member bow containment door 22H, starboard side collapsible member bow containment door to collapsible member starboard side member folding hinge bow support and latching mechanism 22X, port side collapsible member bow containment door to collapsible member bow support and latching mechanism 22W, starboard side collapsible member stern containment door 22C, and port side collapsible member stern containment door 22D; starboard side collapsible member bow containment door hinge support 22J having a starboard side collapsible member bow containment door 22I hingedly attached about starboard side collapsible member bow containment door hinge support 22J, further hingedly connected to forward distal end of starboard hull bottom-to-starboard collapsible member bottom panel hinge 22L, further hingedly connected to forward distal edge of collapsible member starboard side member 22R, functioning to provide a fixed point of rotation for collapsing and opening said collapsible multi-hulled vessel 10 about hingedly connected starboard side collapsible member bow containment door 22I, starboard side collapsible member bow containment door hinge support 22J, starboard hull bottom-to-starboard collapsible member bottom panel hinge 22L, collapsible member starboard side member 22R; port side collapsible member bow containment door hinge support 22K having a port side collapsible member bow containment door 22H hingedly attached about port side collapsible member bow containment door hinge support 22K, further hingedly connected to forward distal end of port hull bottom-to-port collapsible member bottom panel hinge 22L1, further hingedly connected to forward distal edge of collapsible member port side member 22Q, functioning to provide a fixed point of rotation for collapsing and opening said collapsible multi-hulled vessel 10 about hingedly connected port side collapsible member bow containment door 22H, port side collapsible member bow containment door hinge support 22K, port hull bottom-to-port collapsible member bottom panel hinge 22L1, collapsible member port side member 22Q; starboard hull bottom-to-starboard collapsible member bottom panel hinge 22L having a starboard side collapsible member stern containment door to collapsible member starboard side member folding hinge stern support and latching mechanism 22A attached horizontally perpendicular and extending inwardly to the rear distal end of starboard hull bottom-to-starboard collapsible member bottom panel hinge 22L connecting to the rear distal end of collapsible member stern-to-bow main folding hinge 22G, further connecting to a starboard side collapsible member bow containment door to collapsible member starboard side member folding hinge stern support and latching mechanism 22X attached horizontally perpendicular and extending inwardly to the forward distal end of starboard hull bottom-to-starboard collapsible member bottom panel hinge 22L connecting to the forward distal end of collapsible member stern-to-bow main folding hinge 22G, functioning to allow said starboard hull 18B to collapse inwardly toward and about collapsible member stern-to-bow main folding hinge 22G; collapsible member stern-to-bow main folding hinge bow support and latching mechanism 22M being hingably connected to starboard side collapsible member bow containment door 22H and starboard side collapsible member bow containment door 22 functioning to allow the outward movement of said collapsible member bow containment door 22H and starboard side collapsible member bow containment door 22I; collapsible member stern-to-bow main folding hinge stern support and latching mechanism 22N being hingably connected to starboard side collapsible member stern containment door 22C and starboard side collapsible member stern containment door 22D functioning to allow the outward movement of said starboard side collapsible member stern containment door 22C and port side collapsible member stern containment door 22D; starboard side collapsible member stern containment door window 22O located within said starboard side collapsible member stern containment door 22C permitting a person positioned within said compartment to view outwardly; port side collapsible member stern containment door window 22P located within said port side collapsible member stern containment door 22D permitting a person positioned within said compartment to view outwardly; and port side collapsible member bow containment door window 28H contained within said cabin 28 allowing viewing outwardly from said cabin 28.

Figure 4:
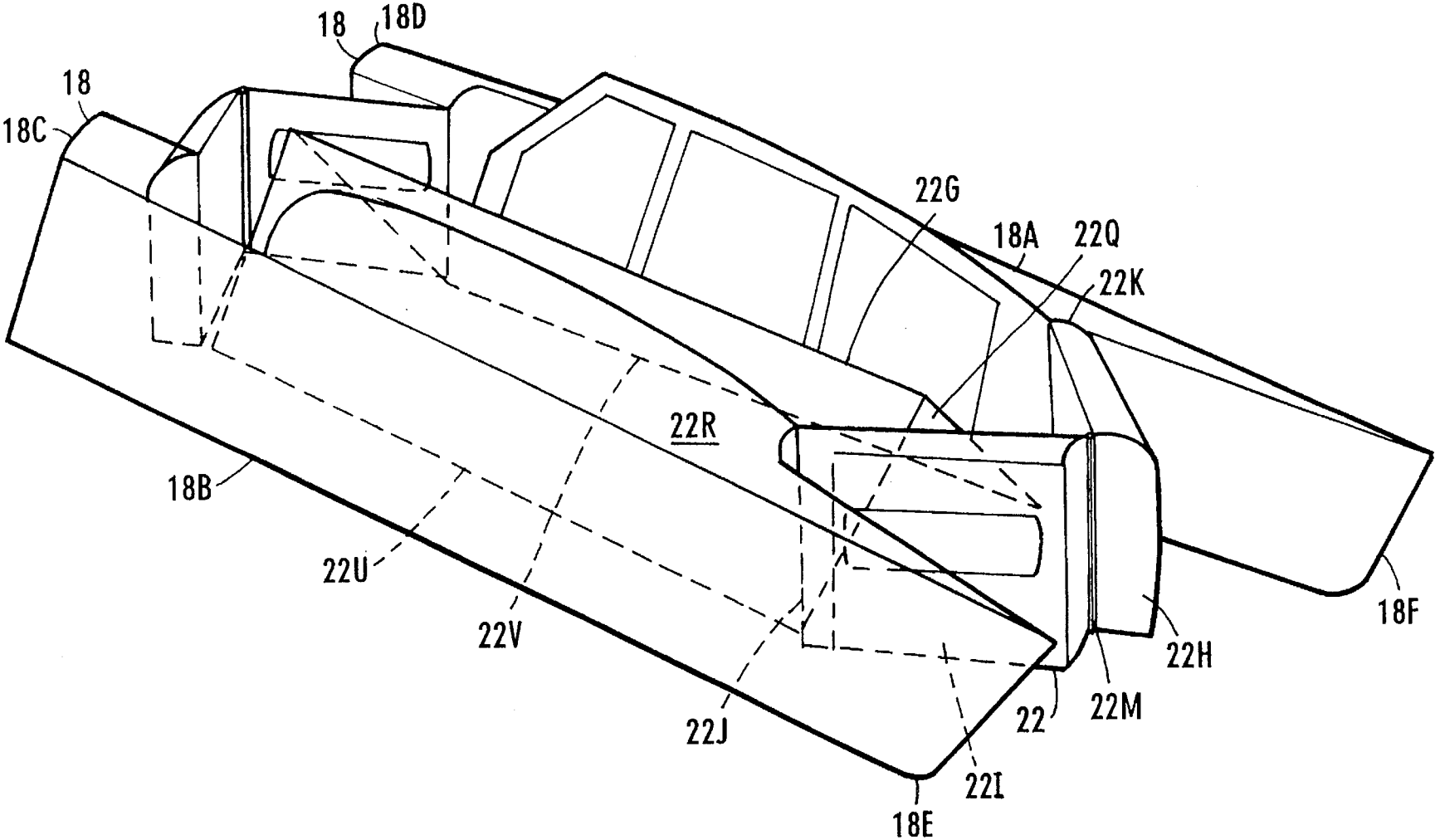
FIG. 4 is a frontal isometric view of the collapsible multi-hulled vessel in collapsing position.

Now, referring to FIG. 4 which is a frontal isometric view of the collapsible multi-hulled vessel in collapsing position exhibiting the following features:hulls 18 providing sufficient buoyancy for said collapsible multi-hulled vessel 10; port hull 18A floating said collapsible multi-hulled vessel 10 starboard hull 18B floating said collapsible multi-hulled vessel 10; collapsible member 22 comprising: starboard side collapsible member stern containment door to collapsible member starboard side member folding hinge stern support and latching mechanism 22A, port side collapsible member stern containment door to collapsible member starboard side member folding hinge stern support and latching mechanism 22B, starboard side collapsible member stern containment door 22C, port side collapsible member stern containment door 22D, starboard side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge support 22K, starboard hull bottom-to-starboard collapsible member bottom, panel hinge 22L, port hull bottom-to-port collapsible member bottom panel, hinge 22L1, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, member inside of starboard hull 22U, starboard side collapsible member stern containment door to collapsible member starboard side member folding hinge stern support and latching mechanism 22A, port side collapsible member stern containment door to collapsible member starboard side member folding hinge stern support and latching mechanism 22B, starboard side collapsible member stern containment door 22C, port side collapsible member stern containment door 22D, starboard side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge support 22K, port hull bottom-to-port collapsible member bottom panel hinge 22L1, starboard hull bottom-to-starboard collapsible member bottom panel hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, member inside of starboard hull 22U, and member inside of port hull 22V; starboard side collapsible member stern containment door 22C having a window 22P, collapsible member port side folding bottom panel 22Q, collapsible member starboard side folding bottom panel 22R, member inside of starboard hull 22U, and member inside of port hull 22V; starboard side collapsible member stern containment door 22C having a starboard side collapsible member stern containment door hinge support 22E positioned at an inward distal end vertically hingedly connecting said starboard side collapsible member stern containment door 22C and connected to collapsible member stern-to-bow main folding hinge stern support and latching mechanism 22N at an opposite distal end, further connected to said starboard side collapsible member stern containment door to collapsible member starboard side member folding hinge stern support and latching mechanism 22A, functioning to provide a rearward vertical containment of an open cockpit being formed between starboard side collapsible member stern containment door 22C, port side collapsible member stern containment door 22D, starboard side collapsible member stern containment door to collapsible member starboard side member folding hinge stern support and latching mechanism 22A, port side collapsible member stern containment door to collapsible member 22B, starboard side collapsible member bow containment door 22I, and port side collapsible member bow containment door 22H; port side collapsible member stern containment door 22D having a port side collapsible member stern containment door hinge support 22F positioned at an inward distal end vertically hingedly connecting said port side collapsible member stern containment door 22D and connected to collapsible member stern-to-bow main folding hinge stern support and latching mechanism 22N at an opposite distal end, further connected to said port side collapsible member stern containment door to collapsible member starboard side member folding hinge stern support and latching mechanism 22B functioning to provide a rearward vertical containment of an open cockpit being formed between port side collapsible member stern containment door 22D, starboard side collapsible member stern containment door 22C, starboard side collapsible member stern containment door to collapsible member starboard side member folding hinge stern support and latching mechanism 22A, port side collapsible member stern containment door to collapsible member port side member folding hinge stern support and latching mechanism 22B, starboard side collapsible member bow containment door 22I, and port side collapsible member bow containment door 22; starboard side collapsible member stern containment door hinge support 22E having a starboard side collapsible member stern containment door 22C hingedly attached about starboard side collapsible member stern containment door hinge support 22E, further hingedly connected to rear distal end of starboard hull bottom-to-port collapsible member bottom panel hinge 22L1, further hingedly connected to rear distal edge of collapsible member starboard side member 22R, functioning to provide a fixed point of rotation for collapsing and opening said collapsible multi-hulled vessel 10 about hingedly connected starboard side collapsible member stern containment door 22C, starboard side collapsible member stern containment door hinge support 22E, starboard hull bottom-to-starboard collapsible member bottom panel hinge 22L, collapsible member starboard side member 22R; port side collapsible member stern containment door hinge support 22F having a port side collapsible member stern containment door 22D hingedly attached about port side collapsible member stern containment door hinge support 22F, further hingedly connected to distal end port hull bottom-to-port collapsible member bottom panel hinge 22L1, further hingedly connected to distal edge of collapsible member port side member 22Q, functioning to provide a fixed point of rotation for collapsing and opening said collapsible multi-hulled vessel 10 about hingedly connected port side collapsible member stern containment door 22D, port side collapsible member stern containment door hinge support 22F, port hull bottom-to-port collapsible member bottom panel hinge 22L1, collapsible member port side member 22Q; starboard side collapsible member bow containment door 22H having a starboard side collapsible member bow containment door hinge support 22K positioned at an inward distal end vertically hingedly connecting said starboard side collapsible member bow containment door 22H and connected to collapsible member stern-to-bow main folding hinge bow support and latching mechanism 22M at an opposite distal end, further connected to said port side collapsible member bow containment door to collapsible member port side member folding hinge bow support and latching mechanism 22W, functioning to provide a forward vertical containment of an open cockpit being formed between starboard side collapsible member bow containment door 22H, starboard side collapsible member bow containment door 22I, port side collapsible member bow containment door to collapsible member port side member folding hinge bow support and latching mechanism 22W, starboard side collapsible member bow containment door to collapsible member starboard side member folding hinge bow support and latching mechanism 22X, starboard side collapsible member stern containment door 22C, and port side collapsible member stern containment door 22D; starboard side collapsible member bow containment door 22I having a starboard side collapsible member bow containment door hinge support 22J positioned at an inward distal end vertically hingedly connecting said starboard side collapsible member bow containment door 22I and connected to collapsible member stern-to-bow main folding hinge bow support and latching mechanism 22M at an opposite distal end, further connected to said starboard side collapsible member bow containment door to collapsible member starboard side member folding hinge bow support and latching mechanism 22X, functioning to provide a forward vertical containment of an open cockpit being formed between starboard side collapsible member bow containment door 22I, port side collapsible member bow containment door 22H, starboard side collapsible member bow containment door to collapsible member starboard side member folding hinge bow support and latching mechanism 22X, port side collapsible member bow containment door to collapsible member port side member folding hinge bow support and latching mechanism 22W, starboard side collapsible member stern containment door 22C, and port side collapsible member stern containment door 22D; starboard side collapsible member bow containment door hinge support 22J having a starboard side collapsible member bow containment door 22I hingedly attached about starboard side collapsible member bow containment door hinge support 22J, further hingedly connected to forward distal end of starboard hull bottom-to-starboard collapsible member bottom panel hinge 22L, further hingedly connected to forward distal edge of collapsible member starboard side member 22R, functioning to provide a fixed point of rotation for collapsing and opening said collapsible multi-hulled vessel 10 about hingedly connected starboard side collapsible member bow containment door 22I, starboard side collapsible member bow containment door hinge support 22J, starboard hull bottom-to-starboard collapsible member bottom panel hinge 22L, collapsible member starboard side member 22R; port side collapsible member bow containment door hinge support 22K having a port side collapsible member bow containment door 22H hingedly attached about port side collapsible member bow containment door hinge support 22K, further hingedly connected to forward distal end of port hull bottom-to-port collapsible member bottom panel hinge 22L1, further hingedly connected to forward distal edge of collapsible member port side member 22Q, functioning to provide a fixed point of rotation for collapsing and opening said collapsible multi-hulled vessel 10 about hingedly connected port side collapsible member bow containment door 22H, port side collapsible member bow containment door hinge support 22K, port hull bottom-to-port collapsible member bottom panel hinge 22L, collapsible member port side member 22Q; starboard hull bottom-to-starboard collapsible member bottom panel hinge 22L having a starboard side collapsible member stern containment door to collapsible member starboard side member folding hinge stern support 22A attached horizontally perpendicular and extending inwardly to the rear distal end of starboard hull bottom-to-starboard collapsible member bottom panel hinge 22L connecting to the rear distal end of collapsible member stern-to-bow main folding hinge 22G, further connecting to a starboard side collapsible member bow containment door to collapsible member starboard side member folding hinge bow support and latching mechanism 22X attached horizontally perpendicular and extending inwardly to the forward distal end of starboard hull bottom-to-starboard collapsible member bottom panel hinge 22L connecting to the forward distal end of collapsible member stern-to-bow main folding hinge 22G, functioning to allow said starboard hull 18B to collapse inwardly toward and about collapsible member stern-to-bow main folding hinge 22G; collapsible member stern-to-bow main folding hinge bow support and latching mechanism 22M being hingably connected to starboard side collapsible member bow containment door 22H and starboard side collapsible member bow containment door 22 functioning to allow the outward movement of said collapsible member bow containment door 22H and starboard side collapsible member bow containment door 22I; collapsible member stern-to-bow main folding hinge stern support and latching mechanism 22N being hingably connected to starboard side collapsible member stern containment door 22C and starboard side collapsible member stern containment door 22D functioning to allow the outward movement of said starboard side collapsible member stern containment door 22C and starboard side collapsible member stern containment door 22D; starboard side collapsible member stern containment door window 22O located within said starboard side collapsible member stern containment door 22C permitting a person positioned within said compartment to view outwardly; port side collapsible member stern containment door window 22P located within said starboard side collapsible member stern containment door 22D permitting a person positioned within said compartment to view outwardly.

Figure 5:
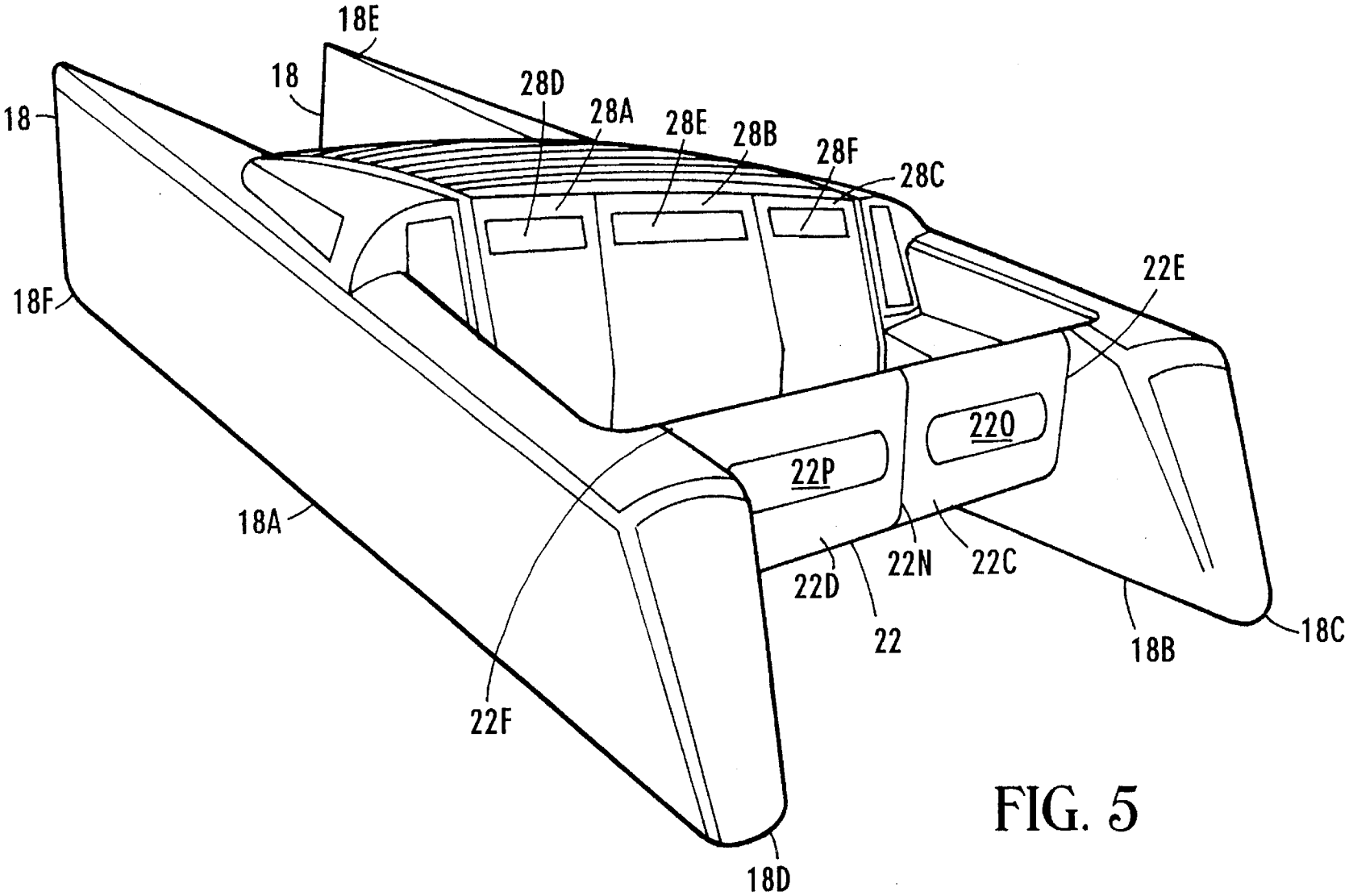
FIG. 5 is a rear isometric view of the collapsible multi-hulled vessel in fully expanded position having a cabin mounted thereon.

Now, referring to FIG. 5 which is a rear isometric view of the collapsible multi-hulled vessel in fully expanded position having a cabin mounted thereon exhibiting the following features: hulls 18 providing sufficient buoyancy for said collapsible multi-hulled vessel 10; starboard hull 18B floating said collapsible multi-hulled vessel 10; port hull 18A floating said collapsible multi-hulled vessel 10; collapsible member 22 comprising: starboard side collapsible member stern containment door to collapsible member starboard side member folding hinge stern starboard 22A, port side collapsible member stern containment door to collapsible member starboard side member folding hinge stern starboard 22B, starboard side collapsible member stern containment door 22C, port side collapsible member stern containment door 22D, starboard side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge support 22K, port hull bottom-to-port collapsible member bottom, panel hinge 22L1, starboard hull bottom-to-starboard collapsible member bottom panel, hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, member inside of port hull 22V, starboard side collapsible member stern containment door to collapsible member starboard side member folding hinge stern support and latching mechanism 22A, port side collapsible member stern containment door to collapsible member port side member folding hinge stern support and latching mechanism 22B, starboard side collapsible member stern containment door 22C, port side collapsible member stern containment door 22D, starboard side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge support 22K, port hull bottom-to-port collapsible member bottom panel hinge 22L1, starboard hull bottom-to-starboard collapsible member bottom panel hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, member inside of starboard hull 22U, and member inside of port hull 22V; starboard side collapsible member stern containment door 22C having a starboard side collapsible member stern containment door hinge support 22E positioned at an inward distal end vertically hingedly connecting said starboard side collapsible member stern containment door 22C and connected to collapsible member stern-to-bow main folding hinge stern support and latching mechanism 22N at an opposite distal end, further connected to said starboard side collapsible member stern containment door to collapsible member starboard side member folding hinge stern support and latching mechanism 22A, functioning to provide a rearward vertical containment of an open cockpit being formed between starboard side collapsible member stern containment door 22C, port side collapsible member stern containment door 22D, starboard side collapsible member stern containment door to collapsible member starboard side member folding hinge stern support and latching mechanism 22A, port side collapsible member stern containment door to collapsible member port side member folding hinge stern support and latching mechanism 22B, starboard side collapsible member bow containment door 22I, and port side collapsible member bow containment door 22H; port side collapsible member stern containment door 22D having a port side collapsible member stern containment door hinge support 22F positioned at an inward distal end vertically hingedly connecting said port side collapsible member stern containment door 22D and connected to collapsible member stern-to-bow main folding hinge stern support and latching mechanism 22N at an opposite distal end, further connected to said port side collapsible member stern containment door to collapsible member starboard side member folding hinge stern support and latching mechanism 22B functioning to provide a rearward vertical containment of an open cockpit being formed between port side collapsible member stern containment door 22D, starboard side collapsible member stern containment door 22C, starboard side collapsible member stern containment door to collapsible member starboard side member folding hinge stern support and latching mechanism 22A, port side collapsible member stern containment door to collapsible member port side member folding hinge stern support and latching mechanism 22B, starboard side collapsible member bow containment door 22I, and port side collapsible member bow containment door 22; starboard side collapsible member stern containment door hinge support 22E having a starboard side collapsible member stern containment door 22C hingedly attached about starboard side collapsible member stern containment door hinge support 22E, further hingedly connected to rear distal end of starboard hull bottom-to-starboard collapsible member bottom panel hinge 22L, further hingedly connected to rear distal edge of collapsible member starboard side member 22R, functioning to provide a fixed point of rotation for collapsing and opening said collapsible multi-hulled vessel 10 about hingedly connected starboard side collapsible member stern containment door 22C, starboard side collapsible member stern containment door hinge support 22E, starboard hull bottom-to-starboard collapsible member bottom panel hinge 22L, collapsible member starboard side member 22R; port side collapsible member stern containment door hinge support 22F having a port side collapsible member stern containment door 22D hingedly attached about port side collapsible member stern containment door hinge support 22F, further hingedly connected to distal end port hull bottom-to-port collapsible member bottom panel hinge 22L1, further hingedly connected to distal edge of collapsible member port side member 22Q, functioning to provide a fixed point of rotation for collapsing and opening said collapsible multi-hulled vessel 10 about hingedly connected port side collapsible member stern containment door 22D, port side collapsible member stern containment door hinge support 22F, port hull bottom-to-port collapsible member bottom panel hinge 22L1, collapsible member port side member 22Q; starboard side collapsible member bow containment door 22H having a starboard side collapsible member bow containment door hinge support 22K positioned at an inward distal end vertically hingedly connecting said starboard side collapsible member bow containment door 22H and connected to collapsible member stern-to-bow main folding hinge bow support and latching mechanism 22M at an opposite distal end, further connected to said starboard side collapsible member bow containment door to collapsible member starboard side member folding hinge bow support and latching mechanism 22X, functioning to provide a forward vertical containment of an open cockpit being formed between starboard side collapsible member bow containment door 22H, starboard side collapsible member bow containment door 22I, starboard side collapsible member bow containment door to collapsible member starboard side member folding hinge bow support and latching mechanism 22X, port side collapsible member bow containment door to collapsible member port side member folding hinge bow support and latching mechanism 22W, starboard side collapsible member stern containment door 22C, and port side collapsible member stern containment door 22D; starboard side collapsible member bow containment door 22I having a starboard side collapsible member bow containment door hinge support 22J positioned at an inward distal end vertically hingedly connecting said starboard side collapsible member bow containment door 22I and connected to collapsible member stern-to-bow main folding hinge bow support and latching mechanism 22M at an opposite distal end, further connected to said starboard side collapsible member bow containment door to collapsible member starboard side member folding hinge bow support and latching mechanism 22X, functioning to provide a forward vertical containment of an open cockpit being formed between starboard side collapsible member bow containment door 22I, port side collapsible member bow containment door 22H, starboard side collapsible member bow containment door to collapsible member starboard side member folding hinge bow support and latching mechanism 22X, port side collapsible member bow containment door to collapsible member port side member folding hinge bow support and latching mechanism 22W, starboard side collapsible member stern containment door 22C, and port side collapsible member stern containment door 22D; starboard side collapsible member bow containment door hinge support 22J having a starboard side collapsible member bow containment door 22I hingedly attached about starboard side collapsible member bow containment door hinge support 22J, further hingedly connected to forward distal end of starboard hull bottom-to-starboard collapsible member bottom panel hinge 22L, further hingedly connected to forward distal edge of collapsible member starboard side member 22R, functioning to provide a fixed point of rotation for collapsing and opening said collapsible multi-hulled vessel 10 about hingedly connected starboard side collapsible member bow containment door 22I, starboard side collapsible member bow containment door hinge support 22J, starboard hull bottom-to-starboard collapsible member bottom panel hinge 22L, collapsible member starboard side member 22R; port side collapsible member bow containment door hinge support 22K having a port side collapsible member bow containment door 22H hingedly attached about port side collapsible member bow containment door hinge support 22K, further hingedly connected to forward distal end of port hull bottom-to-port collapsible member bottom panel hinge 22L1, further hingedly connected to forward distal edge of collapsible member port side member 22Q, functioning to provide a fixed point of rotation for collapsing and opening said collapsible multi-hulled vessel 10 about hingedly connected port side collapsible member bow containment door 22H, port side collapsible member bow containment door hinge support 22K, port hull bottom-to-port collapsible member bottom panel hinge 22L1, collapsible member port side member 22Q; starboard hull bottom-to-starboard collapsible member bottom panel hinge 22L having a starboard side collapsible member stern containment door to collapsible member starboard side member folding hinge stern support and latching mechanism 22A attached horizontally perpendicular and extending inwardly to the rear distal end of starboard hull bottom-to-starboard collapsible member bottom panel hinge 22L connecting to the rear distal end of collapsible member stern-to-bow main folding hinge 22G, further connecting to a starboard side collapsible member bow containment door to collapsible member starboard side member folding hinge stern support 22X attached horizontally perpendicular and extending inwardly to the forward distal end of starboard hull bottom-to-starboard collapsible member bottom panel hinge 22L connecting to the forward distal end of collapsible member stern-to-bow main folding hinge 22G, functioning to allow said starboard hull 18B to collapse inwardly toward and about collapsible member stern-to-bow main folding hinge 22G; collapsible member stern-to-bow main folding hinge bow support and latching mechanism 22M being hingably connected to starboard side collapsible member bow containment door 22H and starboard side collapsible member bow containment door 22 functioning to allow the outward movement of said collapsible member bow containment door 22H and starboard side collapsible member bow containment door 22I; collapsible member stern-to-bow main folding hinge stern support and latching mechanism 22N being hingably connected to starboard side collapsible member stern containment door 22C and port side collapsible member stern containment door 22D functioning to allow the outward movement of said starboard side collapsible member stern containment door 22C and port side collapsible member stern containment door 22D; starboard side collapsible member stern containment door window 22O located within said starboard side collapsible member stern containment door 22C, permitting a person positioned within said compartment to view outwardly; port side collapsible member stern containment door window 22P located within said port side collapsible member stern containment door 22D permitting a person positioned within said compartment to view outwardly; cabin 28 mounted upon port hull 18A, starboard hull 18B, starboard side collapsible member bow containment door 22I and starboard side collapsible member bow containment door 22H functioning to provide waterproof containment therein; cabin stern starboard door 28A attached at a bottom distal end to collapsible member starboard side member 22R and at a top distal end to cabin 28, removable water resistant seal latched to cabin stern middle door 28B at a middle distal end and removable water resistant seal latched to starboard hull 18B at a starboard distal end; cabin stern middle door 28B snaps at bottom distal end to collapsible member starboard side member 22R and collapsible member port side member 22Q and at a top distal end to cabin 28, removable water resistant seal latched to cabin stern starboard door 28A and cabin stern port door 28C at starboard and port distal ends, respectively; cabin stern port door 28C attached at a bottom distal end to collapsible member port side member 22Q and at a top distal end to cabin 28, removable water resistant seal latched to cabin stern middle door 28B at a middle distal end and removable water resistant seal latched to port hull 18A at a port distal end; cabin stern port door window 28D contained within cabin stern port door 28A allowing viewing outwardly from said cabin 28; cabin stern middle door window 28E contained within cabin stern middle door 28B allowing viewing outwardly from said cabin 28; cabin stern starboard door window 28F contained within cabin stern starboard door 28C allowing viewing outwardly from said cabin 28; starboard side collapsible member bow containment door window 28G contained within said cabin 28 allowing viewing outwardly from said cabin 28; and port side collapsible member bow containment door window 28H contained within said cabin 28 allowing viewing outwardly from said cabin 28.

Figure 6:
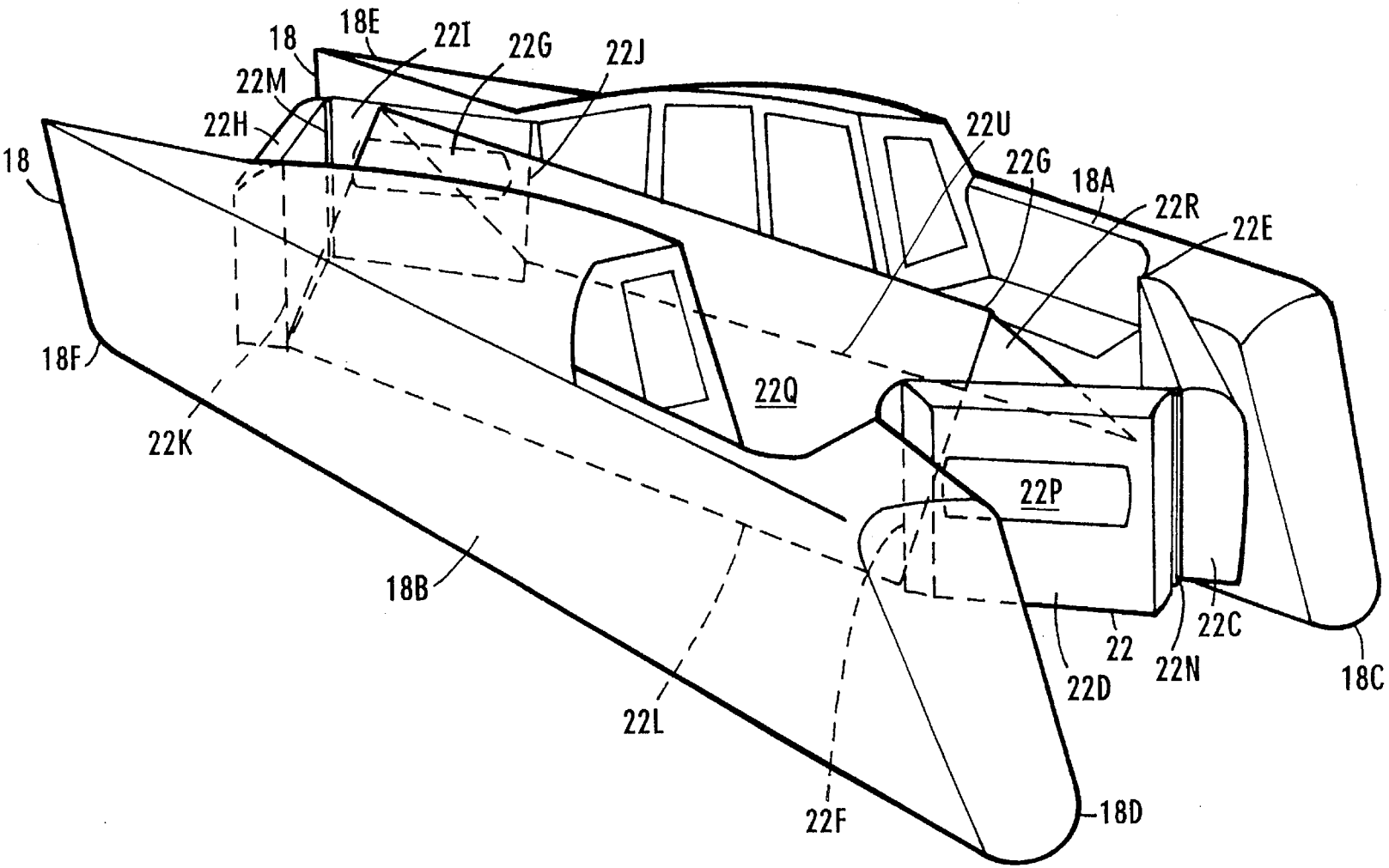
FIG. 6 is a rear isometric view of the collapsible multi-hulled vessel in collapsing position having a cabin mounted thereon.

Now, referring to FIG. 6 which is a rear isometric view of the collapsible multi-hulled vessel in collapsing position having a cabin mounted thereon exhibiting the following features: hulls 18 providing sufficient buoyancy for said collapsible multi-hulled vessel 10; port hull 18A floating said collapsible multi-hulled vessel 10; starboard hull 18B floating said collapsible multi-hulled vessel 10; collapsible member 22 comprising: starboard side collapsible member stern containment door to collapsible member starboard side member folding hinge stern support and latching mechanism 22A, port side collapsible member stern containment door to collapsible member starboard side member folding hinge stern support and latching mechanism 22B, starboard side collapsible member stern containment door 22C, port side collapsible member stern containment door 22D, starboard side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge support 22K, port hull bottom-to-port collapsible member bottom, panel hinge 22L1, starboard hull bottom-to-starboard collapsible member bottom panel, hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, collapsible member inside of starboard hull 22U, starboard side collapsible member stern containment door to collapsible member starboard side member folding hinge stern support and latching mechanism 22A, port side collapsible member stern containment door to collapsible member starboard side member folding hinge stern support and latching mechanism 22B, starboard side collapsible member stern containment door 22C, port side collapsible member stern containment door 22D, starboard side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge starboard 22K, port hull bottom-to-port collapsible member bottom panel hinge 22L1, starboard hull bottom-to-starboard collapsible member bottom panel hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, member inside of starboard hull 22U, and member inside of port hull 22V; starboard side collapsible member stern containment door 22C having a starboard side collapsible member stern containment door hinge support 22E positioned at an inward distal end vertically hingedly connecting said starboard side collapsible member stern containment door 22C and connected to collapsible member stern-to-bow main folding hinge stern support and latching mechanism 22N at an opposite distal end, further connected to said starboard side collapsible member stern containment door to collapsible member starboard side member folding hinge stern support 22A, functioning to provide a rearward vertical containment of an open cockpit being formed between starboard side collapsible member stern containment door 22C, port side collapsible member stern containment door 22D, starboard side collapsible member stern containment door to collapsible member starboard side member folding hinge stern support and latching mechanism 22A, port side collapsible member stern containment door to collapsible member port side member folding hinge stern support and latching mechanism 22B, starboard side collapsible member bow containment door 22I, and port side collapsible member bow containment door 22H; port side collapsible member stern containment door 22D having a port side collapsible member stern containment door hinge support 22F positioned at an inward distal end vertically hingedly connecting said port side collapsible member stern containment door 22D and connected to collapsible member stern-to-bow main folding hinge stern support and latching mechanism 22N at an opposite distal end, further connected to said port side collapsible member stern containment door to collapsible member starboard side member folding hinge stern support and latching mechanism 22B functioning to provide a rearward vertical containment of an open cockpit being formed between port side collapsible member stern containment door 22D, starboard side collapsible member stern containment door 22C, starboard side collapsible member stern containment door to collapsible member starboard side member folding hinge stern support and latching mechanism 22A, port side collapsible member stern containment door to collapsible member port side member folding hinge stern support and latching mechanism 22B, starboard side collapsible member bow containment door 22I, and port side collapsible member bow containment door 22; starboard side collapsible member stern containment door hinge support 22E having a starboard side collapsible member stern containment door 22C hingedly attached about starboard side collapsible member stern containment door hinge support 22E, further hingedly connected to rear distal end of starboard hull bottom-to-starboard collapsible member bottom panel hinge 22L, further hingedly connected to rear distal edge of collapsible member starboard side member 22R, functioning to provide a fixed point of rotation for collapsing and opening said collapsible multi-hulled vessel 10 about hingedly connected starboard side collapsible member stern containment door 22C, starboard side collapsible member stern containment door hinge support 22E, starboard hull bottom-to-starboard collapsible member bottom panel hinge 22L, collapsible member starboard side member 22R; port side collapsible member stern containment door hinge support 22F having a port side collapsible member stern containment door 22D hingedly attached about port side collapsible member stern containment door hinge support 22F, further hingedly connected to distal end port hull bottom-to-port collapsible member bottom panel hinge 22L1, further hingedly connected to distal edge of collapsible member port side member 22Q, functioning to provide a fixed point of rotation for collapsing and opening said collapsible multi-hulled vessel 10 about hingedly connected port side collapsible member stern containment door 22D, port side collapsible member stern containment door hinge support 22F, port hull bottom-to-port collapsible member bottom panel hinge 22L1, collapsible member port side member 22Q; starboard side collapsible member bow containment door 22H having a starboard side collapsible member bow containment door hinge support 22K positioned at an inward distal end vertically hingedly connecting said starboard side collapsible member bow containment door 22H and connected to collapsible member stern-to-bow main folding hinge bow support and latching mechanism 22M at an opposite distal end, further connected to said starboard side collapsible member bow containment door to collapsible member starboard side member folding hinge bow support 22W, functioning to provide a forward vertical containment of an open cockpit being formed between starboard side collapsible member bow containment door 22H, starboard side collapsible member bow containment door 22I, starboard side collapsible member bow containment door to collapsible member starboard side member folding hinge bow support and latching mechanism 22W, starboard side collapsible member bow containment door to collapsible member 22X, starboard side collapsible member stern containment door 22C, and port side collapsible member stern containment door 22D; starboard side collapsible member bow containment door 22I having a starboard side collapsible member bow containment door hinge support 22J positioned at an inward distal end vertically hingedly connecting said starboard side collapsible member bow containment door 22I and connected to collapsible member stern-to-bow main folding hinge bow support and latching mechanism 22M at an opposite distal end, further connected to said starboard side collapsible member bow containment door to collapsible member starboard side member folding hinge bow support and latching mechanism 22X, functioning to provide a forward vertical containment of an open cockpit being formed between starboard side collapsible member bow containment door 22I, port side collapsible member bow containment door 22H, starboard side collapsible member bow containment door to collapsible member starboard side member folding hinge bow support and latching mechanism 22X, port side collapsible member bow containment door to collapsible member port side member folding hinge bow support and latching mechanism 22W, starboard side collapsible member stern containment door 22C, and port side collapsible member stern containment door 22D; starboard side collapsible member bow containment door hinge support 22J having a starboard side collapsible member bow containment door 22I hingedly attached about starboard side collapsible member bow containment door hinge starboard 22J, further hingedly connected to forward distal end of starboard hull bottom-to-starboard collapsible member bottom panel hinge 22L, further hingedly connected to forward distal edge of collapsible member starboard side member 22R, functioning to provide a fixed point of rotation for collapsing and opening said collapsible multi-hulled vessel 10 about hingedly connected starboard side collapsible member bow containment door 22I, starboard side collapsible member bow containment door hinge support 22J, starboard hull bottom-to-starboard collapsible member bottom panel hinge 22L, collapsible member starboard side member 22R; port side collapsible member bow containment door hinge support 22K having a port side collapsible member bow containment door 22H hingedly attached about port side collapsible member bow containment door hinge support 22K, further hingedly connected to forward distal end of port hull bottom-to-port collapsible member bottom panel hinge 22L1, further hingedly connected to forward distal edge of collapsible member port side member 22Q, functioning to provide a fixed point of rotation for collapsing and opening said collapsible multi-hulled vessel 10 about hingedly connected port side collapsible member bow containment door 22H, port side collapsible member bow containment door hinge support 22K, port hull bottom-to-port collapsible member bottom panel hinge 22L1, collapsible member port side member 22Q; starboard hull bottom-to-starboard collapsible member bottom panel hinge 22L having a starboard side collapsible member stern containment door to collapsible member starboard side member folding hinge stern support and latching mechanism 22A attached horizontally perpendicular and extending inwardly to the rear distal end of starboard hull bottom-to-starboard collapsible member bottom panel hinge 22L connecting to the rear distal end of collapsible member stern-to-bow main folding hinge 22G, further connecting to a starboard side collapsible member bow containment door to collapsible member starboard side member folding hinge stern support 22X attached horizontally perpendicular and extending inwardly to the forward distal end of starboard hull bottom-to-starboard collapsible member bottom panel hinge 22L connecting to the forward distal end of collapsible member stern-to-bow main folding hinge 22G, functioning to allow said starboard hull 18B to collapse inwardly toward and about collapsible member stern-to-bow main folding hinge 22G; collapsible member stern-to-bow main folding hinge bow support and latching mechanism 22M being hingably connected to starboard side collapsible member bow containment door 22H and starboard side collapsible member bow containment door 22 functioning to allow the outward movement of said collapsible member bow containment door 22H and starboard side collapsible member bow containment door 22I; collapsible member stern-to-bow main folding hinge stern support and latching mechanism 22N being hingably connected to starboard side collapsible member stern containment door 22C and port side collapsible member stern containment door 22D functioning to allow the outward movement of said starboard side collapsible member stern containment door 22C and port side collapsible member stern containment door 22D; starboard side collapsible member stern containment door window 22O located within said starboard side collapsible member stern containment door 22C permitting a person positioned within said compartment to view outwardly; port side collapsible member stern containment door window 22P located within said port side collapsible member stern containment door 22D permitting a person positioned within said compartment to view outwardly.

Figure 7:
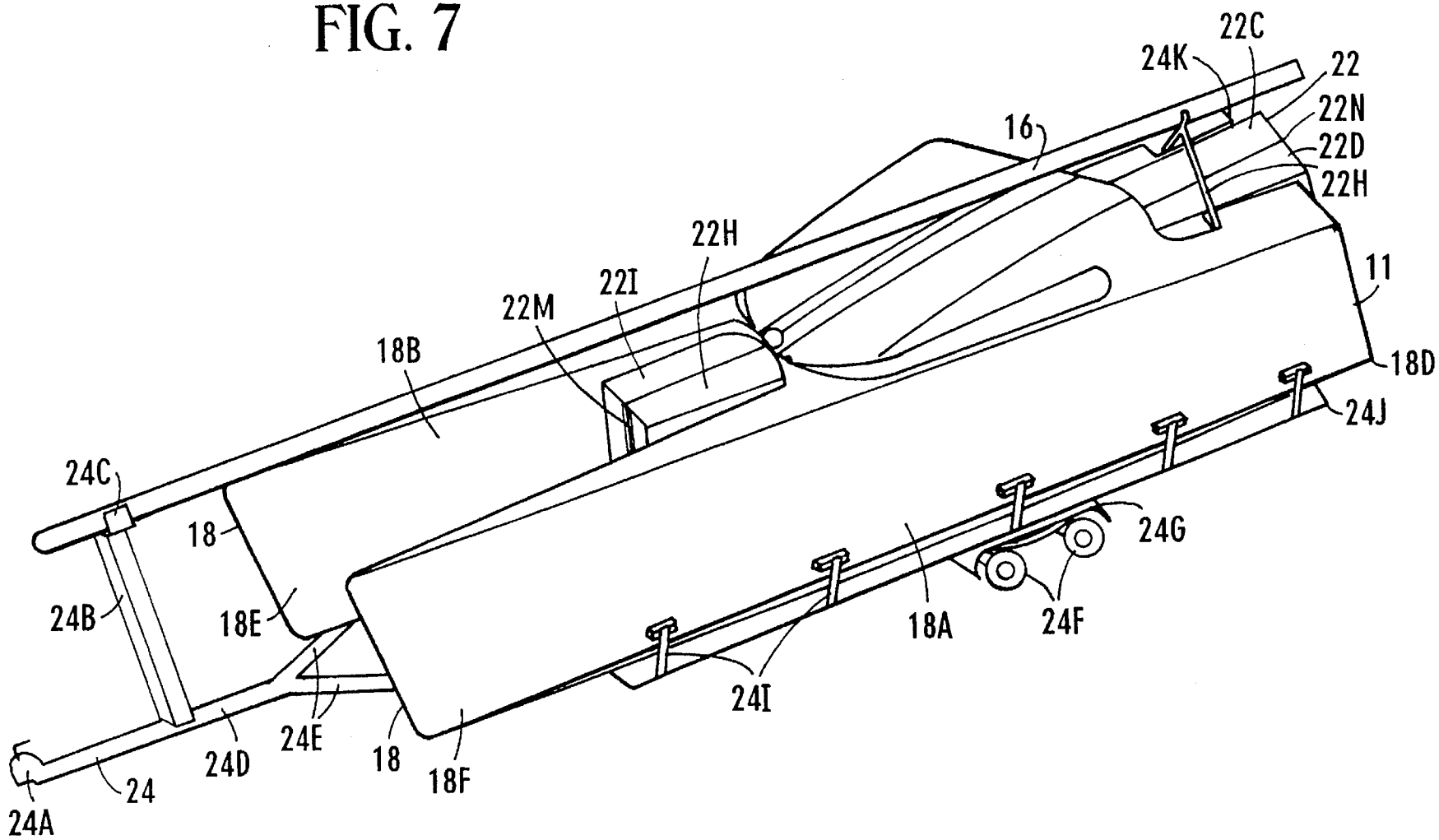
FIG. 7 is a side view of the collapsible multi-hulled vessel in fully collapsed position being mounted on a trailer.

Now, referring to FIG. 7 which is a side view of the collapsible multi-hulled vessel in fully collapsed position being mounted on a trailer exhibiting the following features: hulls 18 providing sufficient buoyancy for said collapsible multi-hulled vessel 10; starboard hull 18A floating said collapsible multi-hulled vessel 10; port hull 18B floating said collapsible multi-hulled vessel 10; stern 11 positioned at the rear distal end of said hull 18; retractable centerboards 12 with a distal end protruding perpendicularly downwardly from said hull 18 forward of said stern 11 and a fixed end attached to said collapsible multi-hulled vessel 10; mast 16 with a distal end protruding perpendicularly upward from said hull 18 forward of said stern 11 and a rotatably fixed end attached to said collapsible multi-hulled vessel 10 having a boom 20 perpendicularly attached to said mast 16 stretching from said rotatably fixed end of said mast 16 aft toward said stern 11 with a main sail 19 affixed to and between said mast 16 and to said boom 20 for capturing wind necessary for propelling the vessel through the water, collapsible member 22 comprising: starboard side collapsible member stern containment door to collapsible member starboard side member folding hinge stern support and latching mechanism 22A, port side collapsible member stern containment door to collapsible member starboard side member folding hinge stern support and latching mechanism 22B, starboard side collapsible member stern containment door 22C, port side collapsible member stern containment door 22D, starboard side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge support 22K, port hull bottom-to-port collapsible member bottom, panel hinge 22L1, starboard hull bottom-to-starboard collapsible member bottom panel, hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, member inside of starboard hull 22U, starboard side collapsible member stern containment door to collapsible member starboard side member folding hinge stern support and latching mechanism 22A, port side collapsible member stern containment door to collapsible member starboard side member folding hinge stern support and latching mechanism 22B, starboard side collapsible member stern containment door 22C, port side collapsible member stern containment door 22D, starboard side collapsible member stern containment door hinge support 22E, port side collapsible member stern containment door hinge support 22F, collapsible member stern-to-bow main folding hinge 22G, port side collapsible member bow containment door 22H, starboard side collapsible member bow containment door 22I, starboard side collapsible member bow containment door hinge support 22J, port side collapsible member bow containment door hinge support 22K, port hull bottom-to-port collapsible member bottom panel hinge 22L1, starboard hull bottom-to-starboard collapsible member bottom panel hinge 22L, collapsible member stern-to-bow main folding hinge bow support and latching mechanism 22M, collapsible member stern-to-bow main folding hinge stern support and latching mechanism 22N, starboard side collapsible member stern containment door window 22O, port side collapsible member stern containment door window 22P, collapsible member port side folding bottom panel 22Q, collapsible member starboard side folding bottom panel 22R, collapsible member inside of starboard hull 22U, and collapsible member inside of port hull 22V; starboard side collapsible member stern containment door 22C having a starboard side collapsible member stern containment door hinge support 22E positioned at an inward distal end vertically hingedly connecting said starboard side collapsible member stern containment door 22C and connected to collapsible member stern-to-bow main folding hinge stern support and latching mechanism 22N at an opposite distal end, further connected to said starboard side collapsible member stern containment door to collapsible member starboard side member folding hinge stern support and latching mechanism 22A, functioning to provide a rearward vertical containment of an open cockpit being formed between starboard side collapsible member stern containment door 22C, port side collapsible member stern containment door 22D, starboard side collapsible member stern containment door to collapsible member starboard side member folding hinge stern support and latching mechanism 22A, port side collapsible member stern containment door to collapsible member port side member folding hinge port support and latching mechanism 22B, starboard side collapsible member bow containment door 22I, and port side collapsible member bow containment door 22H; port side collapsible member stern containment door 22D having a port side collapsible member stern containment door hinge support 22F positioned at an inward distal end vertically hingedly connecting said port side collapsible member stern containment door 22D and connected to collapsible member stern-to-bow main folding hinge stern support and latching mechanism 22N at an opposite distal end, further connected to said port side collapsible member stern containment door to collapsible member starboard side member folding hinge stern support and latching mechanism 22B functioning to provide a rearward vertical containment of an open cockpit being formed between port side collapsible member stern containment door 22D, starboard side collapsible member stern containment door 22C, starboard side collapsible member stern containment door to collapsible member starboard side member folding hinge stern support and latching mechanism 22A, port side collapsible member stern containment door to collapsible member port side member folding hinge port support and latching mechanism 22B, starboard side collapsible member bow containment door 22I, and port side collapsible member bow containment door 22; starboard side collapsible member stern containment door hinge support 22E having a starboard side collapsible member stern containment door 22C hingedly attached about starboard side collapsible member stern containment door hinge support 22E, further hingedly connected to rear distal end of starboard hull bottom-to-starboard collapsible member bottom panel hinge 22L, further hingedly connected to rear distal edge of collapsible member starboard side member 22R, functioning to provide a fixed point of rotation for collapsing and opening said collapsible multi-hulled vessel 10 about hingedly connected starboard side collapsible member stern containment door 22C, starboard side collapsible member stern containment door hinge support 22E, starboard hull bottom-to-starboard collapsible member bottom panel hinge 22L, collapsible member starboard side member 22R; port side collapsible member stern containment door hinge support 22F having a port side collapsible member stern containment door 22D hingedly attached about port side collapsible member stern containment door hinge support 22F, further hingedly connected to distal end port hull bottom-to-port collapsible member bottom panel hinge 22L1, further hingedly connected to distal edge of collapsible member port side member 22Q, functioning to provide a fixed point of rotation for collapsing and opening said collapsible multi-hulled vessel 10 about hingedly connected port side collapsible member stern containment door 22D, port side collapsible member stern containment door hinge support 22F, port hull bottom-to-port collapsible member bottom panel hinge 22L1, collapsible member port side member 22Q; starboard side collapsible member bow containment door 22H having a starboard side collapsible member bow containment door hinge starboard 22K positioned at an inward distal end vertically hingedly connecting said starboard side collapsible member bow containment door 22H and connected to collapsible member stern-to-bow main folding hinge bow support and latching mechanism 22M at an opposite distal end, further connected to said starboard side collapsible member bow containment door to collapsible member starboard side member folding hinge bow support and latching mechanism 22W, functioning to provide a forward vertical containment of an open cockpit being formed between starboard side collapsible member bow containment door 22H, starboard side collapsible member bow containment door 22I, starboard side collapsible member bow containment door to collapsible member starboard side member folding hinge bow support and latching mechanism 22W, starboard side collapsible member bow containment door to collapsible member port side member folding hinge bow support and latching mechanism 22X, starboard side collapsible member stern containment door 22C, and port side collapsible member stern containment door 22D; starboard side collapsible member bow containment door 22I having a starboard side collapsible member bow containment door hinge support 22J positioned at an inward distal end vertically hingedly connecting said starboard side collapsible member bow containment door 22I and connected to collapsible member stern-to-bow main folding hinge bow support and latching mechanism 22M at an opposite distal end, further connected to said starboard side collapsible member bow containment door to collapsible member starboard side member folding hinge bow support and latching mechanism 22X, functioning to provide a forward vertical containment of an open cockpit being formed between starboard side collapsible member bow containment door 22I, port side collapsible member bow containment door 22H, starboard side collapsible member bow containment door to collapsible member starboard side member folding hinge bow support and latching mechanism 22X, port side collapsible member bow containment door to collapsible member port side member folding hinge bow support and latching mechanism 22W, starboard side collapsible member stern containment door 22C, and port side collapsible member stern containment door 22D; starboard side collapsible member bow containment door hinge support 22J having a starboard side collapsible member bow containment door 22I hingedly attached about starboard side collapsible member bow containment door hinge support 22J, further hingedly connected to forward distal end of starboard hull bottom-to-starboard collapsible member bottom panel hinge 22L, further hingedly connected to forward distal edge of collapsible member starboard side member 22R, functioning to provide a fixed point of rotation for collapsing and opening said collapsible multi-hulled vessel 10 about hingedly connected starboard side collapsible member bow containment door 22I, starboard side collapsible member bow containment door hinge support 22J, starboard hull bottom-to-starboard collapsible member bottom panel hinge 22L, collapsible member starboard side member 22R; port side collapsible member bow containment door hinge support 22K having a port side collapsible member bow containment door 22H hingedly attached about port side collapsible member bow containment door hinge support 22K, further hingedly connected to forward distal end of port hull bottom-to-port collapsible member bottom panel hinge 22L1, further hingedly connected to forward distal edge of collapsible member port side member 22Q, functioning to provide a fixed point of rotation for collapsing and opening said collapsible multi-hulled vessel 10 about hingedly connected port side collapsible member bow containment door 22H, port side collapsible member bow containment door hinge support 22K, port hull bottom-to-port collapsible member bottom panel hinge 22L1, collapsible member port side member 22Q; starboard hull bottom-to-starboard collapsible member bottom panel hinge 22L having a starboard side collapsible member stern containment door to collapsible member starboard side member folding hinge stern support and latching mechanism 22A attached horizontally perpendicular and extending inwardly to the rear distal end of starboard hull bottom-to-starboard collapsible member bottom panel hinge 22L connecting to the rear distal end of collapsible member stern-to-bow main folding hinge 22G, further connecting to a starboard side collapsible member bow containment door to collapsible member starboard side member folding hinge stern support and latching mechanism 22X attached horizontally perpendicular and extending inwardly to the forward distal end of starboard hull bottom-to-starboard collapsible member bottom panel hinge 22L connecting to the forward distal end of collapsible member stern-to-bow main folding hinge 22G, functioning to allow said starboard hull 18B to collapse inwardly toward and about collapsible member stern-to-bow main folding hinge 22G; collapsible member stern-to-bow main folding hinge bow support and latching mechanism 22M being hingably connected to starboard side collapsible member bow containment door 22H and starboard side collapsible member bow containment door 22 functioning to allow the outward movement of said collapsible member bow containment door 22H and starboard side collapsible member bow containment door 22I; collapsible member stern-to-bow main folding hinge stern support and latching mechanism 22N being hingably connected to starboard side collapsible member stern containment door 22C and starboard side collapsible member stern containment door 22D functioning to allow the outward movement of said starboard side collapsible member stern containment door 22C and starboard side collapsible member stern containment door 22D; starboard side collapsible member stern containment door window 22O located within said starboard side collapsible member stern containment door 22C permitting a person positioned within said compartment to view outwardly; port side collapsible member stern containment door window 22P located within said port side collapsible member stern containment door 22D permitting a person positioned within said compartment to view outwardly; trailer 24 comprising: trailer hitch coupler 24A, trailer mast forward starboard 24B, trailer mast starboard mast containment holder 24C, trailer mast starboard mast containment holder 24C, trailer straight starboard tounge 24D, trailer Frame member 24E, a plurality of trailer wheels 24F, a plurality of trailer wheel guards 24G, trailer mast rear starboard 24H, trailer lateral starboard guides 24I, starboard hull trailer starboard member 24J, and port hull trailer starboard member 24K; trailer hitch coupler 24A connected to trailer straight starboard tounge 24D functioning to attach said trailer 24 to a vehicle for transport starboard; trailer mast forward starboard 24B connected to trailer straight starboard tounge 24D at a lower distal end and to trailer mast starboard mast containment holder 24C at an upper distal end; connected to trailer mast forward starboard 24B functioning to starboard mast 16 during transport; trailer straight starboard tounge 24D connected at a front distal end to trailer hitch coupler 24A and at a rear distal end to trailer Frame member 24E having trailer mast forward starboard 24B mounted thereon; trailer frame member 24E connected at a front distal end trailer straight starboard tounge 24D and connected at a rear distal end to starboard hull trailer starboard member 24J and starboard hull trailer starboard member 24K; a plurality of trailer wheels 24F connected to an axial securely mounted to starboard hull trailer starboard member 24J and port hull trailer starboard member 24K; plurality of trailer wheel guards 24G securely mounted on starboard hull trailer starboard member 24J and port hull trailer starboard member 24K; trailer mast rear starboard 24H securely mounted upon starboard hull trailer starboard member 24J and port hull trailer starboard member 24K; trailer lateral starboard guides 24I securely mounted upon starboard hull trailer starboard member 24J and port hull trailer starboard member 24K functioning to tile multi-hulled vessel 10; starboard hull trailer starboard member 24J connected at a front distal end to trailer Frame member 24E and securely fastened to plurality of trailer wheel guards 24G and trailer lateral starboard guides 24I; port hull trailer starboard member 24K connected at a front distal end to trailer Frame member 24E and securely fastened to plurality of trailer wheel guards 24G and trailer lateral starboard guides 24I.

Figure 8:
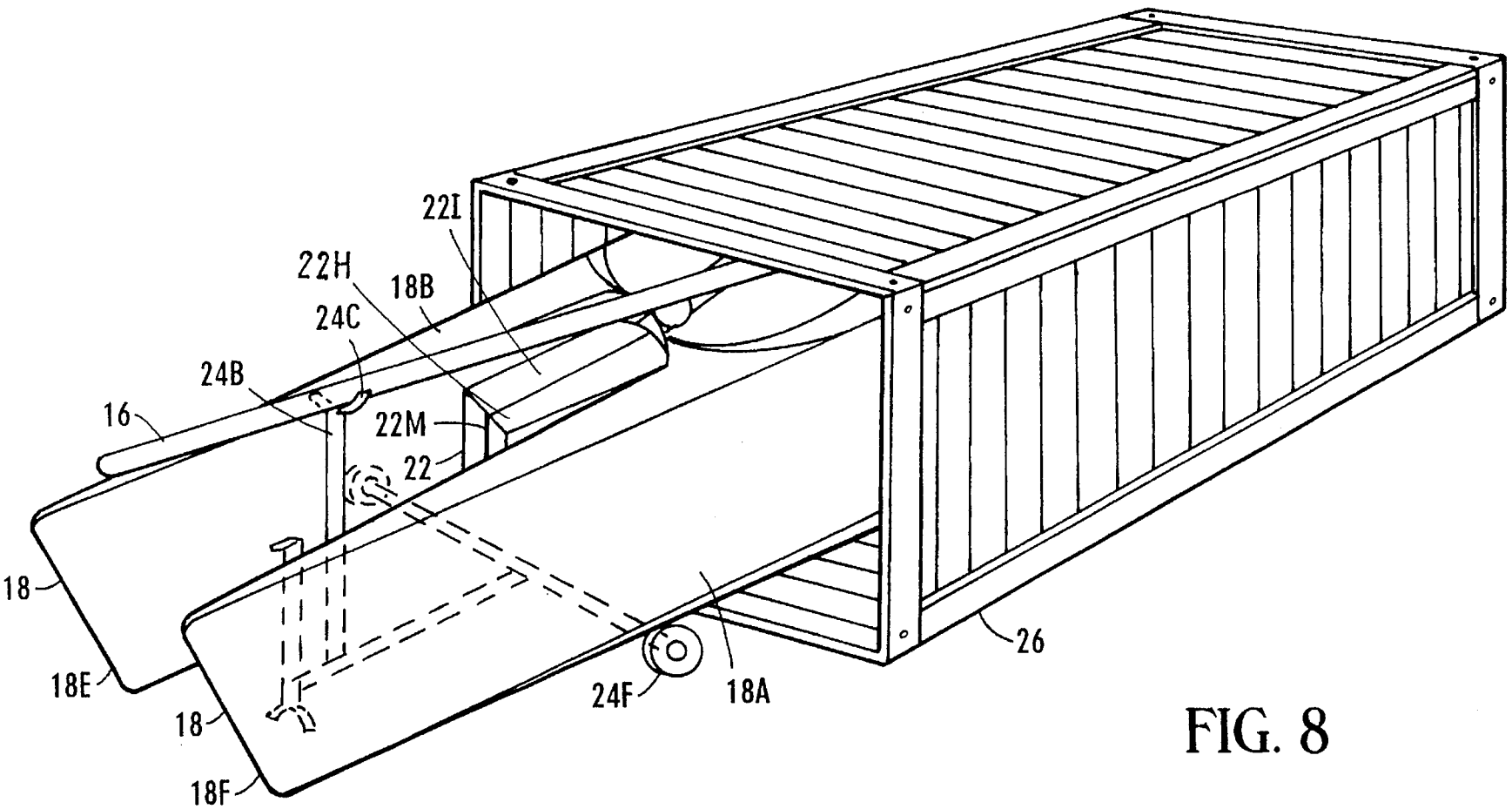
FIG. 8 is a frontal isometric view of the collapsible multi-hulled vessel in fully collapsed position being mounted on a trailer being placed within a garage and/or storage box.

Now, referring to FIG. 8 which is a frontal isometric view of the collapsible multi-hulled vessel in fully collapsed position being mounted on a trailer being placed within a garage and/or storage box exhibiting the same features as FIG. 7.

Referring to FIG. 9 which is a diagrammatic step-by-step representation of the method utilized to collapse said invention. The collapsible multi-hulled vessel containment doors are centrally hinged and connected to a center locking mechanism which is moved by a string or pulley moving the multiple hulls axially relative to and towards each other folding the containment doors outwardly and collapsing the hulls together. The pairs of centrally hinged containment doors located on both the stern end and the bow end of the vessel are unlatched and fold outwardly to allow the hulls sufficient clearance when collapsing together. The mast and rigging is stepped in the front center of the vessel with the possibility of one or more mast braces connecting to one end of the mast the other end to any respective hull. When the mast is folded down to lie horizontally, it pivots rotatably about a connection point to the vessel with the mast and rigging intact, while at the same time the containment doors collapse forwardly bringing the hulls together. The vessel is then placed on a trailer for easy transport and can be stored in its collapsed position for storage.

To open the collapsible multi-hulled vessel, a string and/or pulley is used to move the multiple hulls axially relative and away from each other hereby opening the vessel. Pairs of centrally hinged containment doors located on both the stern end and the bow end of the vessel fold inwardly and are then latched to ascertain and securely maintain the vessels specific and constant width. The mast and rigging is raised as a single intact unit, further simplifying the assembly of the vessel.

In essence, the present invention relates to a collapsible multi-hulled vessel which is simple to open, close and transport by using a line( s ) requiring no electrical assistance.

It will be understood that each of the elements described above, or two or more together, may also find a useful application in other types of constructions differing from the type described above.

While the invention has been illustrated and described as embodied in a collapsible multi-hulled vessel, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A collapsible multi-hulled apparatus which comprises:

a) a starboard side collapsible member stern containment door to collapsible member starboard side member folding hinge stern support and latching mechanism;

b) a port side collapsible member stern containment door to collapsible member port side member folding hinge stern support and latching mechanism;

c) a starboard side collapsible member stern containment door;

d) a port side collapsible member stern containment door;

e) a starboard side collapsible member stern containment door hinge support;

f) a port side collapsible member stern containment door hinge support;

g) a collapsible member stern-to-bow main folding hinge;

h) a port side collapsible member bow containment door;

i) a starboard side collapsible member bow containment door;

j) a starboard side collapsible member bow containment door hinge support;

k) a port side collapsible member bow containment door hinge support;

l) a port hull bottom-to-port collapsible member bottom panel hinge;

m) a starboard hull bottom-to-starboard collapsible member bottom panel hinge;

n) a collapsible member stern-to-bow main folding hinge bow support and latching mechanism;

o) a collapsible member stern-to-bow main folding hinge stern support and latching mechanism;

p) a collapsible member port side folding bottom panel;

q) a collapsible member starboard side folding bottom panel;

r) a member inside of port hull;

s) a member inside of starboard hull;

t) a port side collapsible member stern containment door to collapsible member starboard side member folding hinge bow support and latching mechanism;

u) a starboard side collapsible member stern containment door to collapsible member starboard side member folding hinge bow support and latching mechanism; and v) a plurality of hulls.

2. The collapsible multi-hulled apparatus as described in claim 1 wherein said hulls further comprise:

a) a port hull;

b) a starboard hull;

c) a starboard hull stern end;

d) a port hull stern end;

e) a starboard hull bow end; and f) a port hull bow end.

3. The collapsible multi-hulled apparatus as described in claim 1 wherein said side collapsible member stern containment doors have windows contained therein.

4. The collapsible multi-hulled apparatus as described in claim 1 wherein said collapsible multi-hulled apparatus further comprises:

a) at least one retractable centerboard;

b) at least one mast;

c) at least one sail;

d) at least one boom; and e) a cabin.

5. A method of collapsing a collapsible multi-hulled apparatus having a collapsible member stern-to-bow main folding hinge bow support, port side collapsible member bow containment door, starboard side collapsible member bow containment door, port side collapsible member bow containment door hinge support and latching mechanism, starboard side collapsible member bow containment door hinge support, collapsible member stern-to-bow main folding hinge stern support, port side collapsible member stern containment door, starboard side collapsible member stern containment door, port side collapsible member stern containment door hinge support and latching mechanism, starboard side collapsible member stern containment door hinge support, collapsible member stern-to-bow main folding hinge, collapsible member port side folding bottom panel, collapsible member starboard side folding bottom panel, port hull bottom-to-port panel hinge, and starboard hull bottom-to-starboard panel hinge comprising the following steps:

a) pushing outwardly in a forward direction said collapsible member stern-to-bow main folding hinge bow support resulting in simultaneous outward opening of said port side collapsible member bow containment door and said starboard side collapsible member bow containment door being hingedly connected to said port side collapsible member bow containment door hinge support and latching mechanism and said starboard side collapsible member bow containment door hinge support;

b) pushing outwardly in a forward direction said collapsible member stern-to-bow main folding hinge stern support resulting in simultaneous outward opening of said port side collapsible member stern containment door and said starboard side collapsible member stern containment door being hingedly connected to said port side collapsible member stern containment door hinge support and latching mechanism and said starboard side collapsible member stern containment door hinge support;

c) lifting upwardly said collapsible member stern-to-bow main folding hinge resulting in simultaneous upward lifting of said collapsible member port side folding bottom panel and said collapsible member starboard side folding bottom panel being hingedly connected at an opposite longitudinal distal end to said port hull bottom-to-port panel hinge and said starboard hull bottom-to-starboard panel hinge; and d) collapse said plurality of hulls together in a compact configuration.

6. A collapsible multi-hulled apparatus which comprises:

a port hull;

a starboard hull; and a plurality of support members extending between said port hull and said starboard hull to separate said port hull from said starboard hull by an established distance, each said support member having a port end hingably attached to said port hull, a starboard end hingably attached to said starboard hull, and a hinged section bifurcating said support member substantially midway between said port hull and said starboard hull with said hinged section being moveable to collapse said port hull and said starboard hull towards each other.

7. A collapsible multi-hulled apparatus as recited in claim 6, wherein said support members further comprise:

a plurality of vertical support members; and a horizontal support member engageable with said vertical support members to establish a substantially waterproof containment.

* * * * *